US011810489B2

(12) United States Patent
Lee et al.

(10) Patent No.: US 11,810,489 B2
(45) Date of Patent: Nov. 7, 2023

(54) SENSING CIRCUIT FOR DETECTING CHARACTERISTICS OF DISPLAY PANEL AND DISPLAY DRIVER INTEGRATED CIRCUIT INCLUDING THE SAME

(71) Applicant: SAMSUNG ELECTRONICS CO., LTD., Suwon-si (KR)

(72) Inventors: Hajun Lee, Seoul (KR); Jeongah Ahn, Hwaseong-si (KR); Youngsub Jin, Seoul (KR)

(73) Assignee: Samsung Electronics Co., Ltd.

( * ) Notice: Subject to any disclaimer, the term of this patent is extended or adjusted under 35 U.S.C. 154(b) by 21 days.

(21) Appl. No.: 17/535,874

(22) Filed: Nov. 26, 2021

(65) Prior Publication Data

US 2022/0335866 A1 Oct. 20, 2022

(30) Foreign Application Priority Data

Apr. 19, 2021 (KR) ..... 10-2021-0050649

(51) Int. Cl.
*G09G 3/00* (2006.01)
*G09G 3/3291* (2016.01)

(52) U.S. Cl.
CPC ..... *G09G 3/006* (2013.01); *G09G 3/3291* (2013.01); *G09G 2320/045* (2013.01); *G09G 2330/12* (2013.01)

(58) Field of Classification Search
CPC ..... G09G 3/006; G09G 2300/0426; G09G 3/3291; G09G 2320/045; G09G 2330/12; G09G 3/3233; G09G 2310/0286; G09G 2310/0289; G09G 2320/0295; G09G 3/3275; G09G 3/3266; G09G 2320/043; H10K 59/131; H10K 59/1201; H10K 59/129; H10K 71/70; G09F 9/30; H01L 22/14; H01L 22/32; H05K 1/0268; H05K 1/111
See application file for complete search history.

(56) References Cited

U.S. PATENT DOCUMENTS 9,721,502 B2 8/2017 Bi et al.
10,282,044 B2 5/2019 Min et al.
(Continued)

FOREIGN PATENT DOCUMENTS

KR 20070080427 A * 8/2007
KR 1549343 B1 8/2015
KR 2156784 A 3/2016

*Primary Examiner* — Grant Sitta
(74) *Attorney, Agent, or Firm* — Fish & Richardson P.C.

(57) ABSTRACT

A sensing circuit includes initialization switches, shield switches, signal selection switches and a signal current integrator. The initialization switches apply an initialization voltage to sensing channels based on an initialization control signal. The shield switches apply a shield voltage different from the initialization voltage to the sensing channels based on shield control signals. The signal selection switches sequentially output sensing currents received from the sensing channels based on sensing control signals. The signal current integrator sequentially converts the sensing currents into sensing voltages. When a target sensing current is to be detected from a target sensing channel from the sensing channels, the shield voltage is applied to at least one shield sensing channel adjacent to the target sensing channel from the sensing channels.

20 Claims, 29 Drawing Sheets

(56) References Cited

U.S. PATENT DOCUMENTS

| | | | | |
|---|---|---|---|---|
| 10,296,137 | B2 | 5/2019 | Yang et al. | |
| 10,429,990 | B2 | 10/2019 | Kang et al. | |
| 2017/0005667 | A1* | 1/2017 | Shirahama | G01T 1/20 |
| 2020/0043414 | A1* | 2/2020 | Wang | G09G 3/3233 |
| 2020/0243043 | A1* | 7/2020 | Leerentveld | G09G 3/3233 |

* cited by examiner

SENSING CIRCUIT FOR DETECTING CHARACTERISTICS OF DISPLAY PANEL AND DISPLAY DRIVER INTEGRATED CIRCUIT INCLUDING THE SAME

CROSS-REFERENCE TO RELATED APPLICATION

This application claims priority under 35 USC § 119 to Korean Patent Application No. 10-2021-0050649 filed on Apr. 19, 2021 in the Korean Intellectual Property Office (KIPO), the contents of which are hereby incorporated by reference in their entirety.

BACKGROUND

1. Technical Field

Exemplary embodiments relate generally to semiconductor integrated circuits, and more particularly to sensing circuits for detecting characteristics of display panels, and display driver integrated circuits including such sensing circuits.

2. Description of the Related Art

As information technology evolves, display devices become important to provide timely information to a user. Various display devices such as liquid crystal displays (LCDs), plasma displays, and electroluminescent displays have gained in popularity. Among these, electroluminescent displays using light-emitting diodes (LEDs) or organic light-emitting diodes (OLEDs) that emit light through recombination of electrons and holes are preferred for their quick response speeds and reduced power consumption.

Electroluminescent displays provide the advantages of rapid response and low power consumption. Related technology, OLED display devices supply a current corresponding to a data signal using driving transistors for respective pixels to generate light through the OLEDs of the respective pixels. As such, the electroluminescent display device uses current to generate a display image. The performance of driving transistors and the OLEDs deteriorate with time of usage, and to compensate for this deterioration, it is necessary to continuously sense and measure this degree of deterioration.

SUMMARY

At least one exemplary embodiment of the present disclosure provides a sensing circuit capable of efficiently detecting characteristics of pixels included in a display panel.

At least one exemplary embodiment of the present disclosure provides a display driver integrated circuit including the sensing circuit.

According to exemplary embodiments, a sensing circuit that is connected to a plurality of pixels in a display panel through a plurality of sensing channels includes a plurality of initialization switches, a plurality of shield switches, a plurality of signal selection switches and a signal current integrator. The plurality of initialization switches apply an initialization voltage to the plurality of sensing channels based on an initialization control signal. The plurality of shield switches apply a shield voltage different from the initialization voltage to the plurality of sensing channels based on a plurality of shield control signals. The plurality of signal selection switches sequentially output a plurality of sensing currents received from the plurality of sensing channels based on a plurality of sensing control signals. The signal current integrator sequentially converts the plurality of sensing currents into a plurality of sensing voltages. When a target sensing current is to be detected from a target sensing channel from the plurality of sensing channels, the shield voltage is applied to at least one shield sensing channel adjacent to the target sensing channel from the plurality of sensing channels.

According to exemplary embodiments, a display driver integrated circuit that drives a display panel including a plurality of pixels includes a data driver. The data driver generates a plurality of data voltages applied to the plurality of pixels, and includes a sensing circuit that detects characteristics of the plurality of pixels through a plurality of sensing channels. The sensing circuit includes a plurality of initialization switches, a plurality of shield switches, a plurality of signal selection switches and a signal current integrator. The plurality of initialization switches apply an initialization voltage to the plurality of sensing channels based on an initialization control signal. The plurality of shield switches apply a shield voltage different from the initialization voltage to the plurality of sensing channels based on a plurality of shield control signals. The plurality of signal selection switches sequentially output a plurality of sensing currents received from the plurality of sensing channels based on a plurality of sensing control signals. The signal current integrator sequentially converts the plurality of sensing currents into a plurality of sensing voltages. When a target sensing current is to be detected from a target sensing channel from the plurality of sensing channels, the shield voltage is applied to at least one shield sensing channel adjacent to the target sensing channel from the plurality of sensing channels.

According to exemplary embodiments, a sensing circuit that is connected to a plurality of pixels in a display panel through a first sensing channel to an X-th sensing channel, where X is a natural number greater than or equal to three, includes a first initialization switch to an X-th initialization switch, a first shield switch to an X-th shield switch, a first signal selection switch to an X-th signal selection switch, an operational amplifier, a reset switch and a feedback capacitor. The first to X-th initialization switches are connected to the first to X-th sensing channels, and simultaneously apply an initialization voltage to the first to X-th sensing channels based on an initialization control signal. The first to X-th shield switches are connected to the first to X-th sensing channels, and apply a shield voltage different from the initialization voltage to the first to X-th sensing channels based on a first shield control signal to an X-th shield control signal. The first to X-th signal selection switches are connected to the first to X-th sensing channels, and sequentially output a first sensing current to an X-th sensing current received from the first to X-th sensing channels based on a first sensing control signal to an X-th sensing control signal. The operational amplifier includes a first input terminal sequentially receiving the first to X-th sensing currents, a second input terminal receiving the initialization voltage, and an output terminal sequentially outputting a first sensing voltage to an X-th sensing voltage. The reset switch is connected between the first input terminal and the output terminal of the operational amplifier. A feedback capacitor is connected in parallel with the reset switch between the first input terminal and the output terminal of an operational amplifier. The initialization voltage and the shield voltage have a same voltage level. When the first sensing channel is selected as a target sensing channel from among the first to X-th sensing channels, a second sensing channel is selected as a shield sensing channel from the first to X-th sensing channels, and the shield voltage is applied to the second sensing channel. When a K-th sensing channel is selected as the target sensing channel from the first to X-th sensing channels, where K is a natural number greater than or equal to two and less than or equal to (X−1), a (K−1)-th sensing channel and a (K+1)-th sensing channel are selected as the shield sensing channel from among the first to X-th sensing channels, and the shield voltage is applied to the (K−1)-th and (K+1)-th sensing channels. When the X-th sensing channel is selected as the target sensing channel from among the first to X-th sensing channels, an (X−1)-th sensing channel is selected as the shield sensing channel from among the first to X-th sensing channels, and the shield voltage is applied to the (X−1)-th sensing channel.

The sensing circuit and the display driver integrated circuit according to exemplary embodiments may be implemented based on the serial current sensing scheme in which the sensing operation is sequentially performed on the plurality of sensing channels using one signal current integrator. In addition, the sensing circuit and the display driver integrated circuit may be implemented based on the active shielding scheme in which the at least one sensing channel adjacent to the target sensing channel is selected or set as the shield sensing channel during the sensing operation for the target sensing channel, the shield voltage is applied to the at least one shield sensing channel, and the at least one shield sensing channel is sequentially changed to correspond to the change of the target sensing channel. Accordingly, the coupling noise from an adjacent sensing channel may be efficiently prevented or reduced, and the sensing performance and accuracy may be improved and enhanced.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Figure 1:
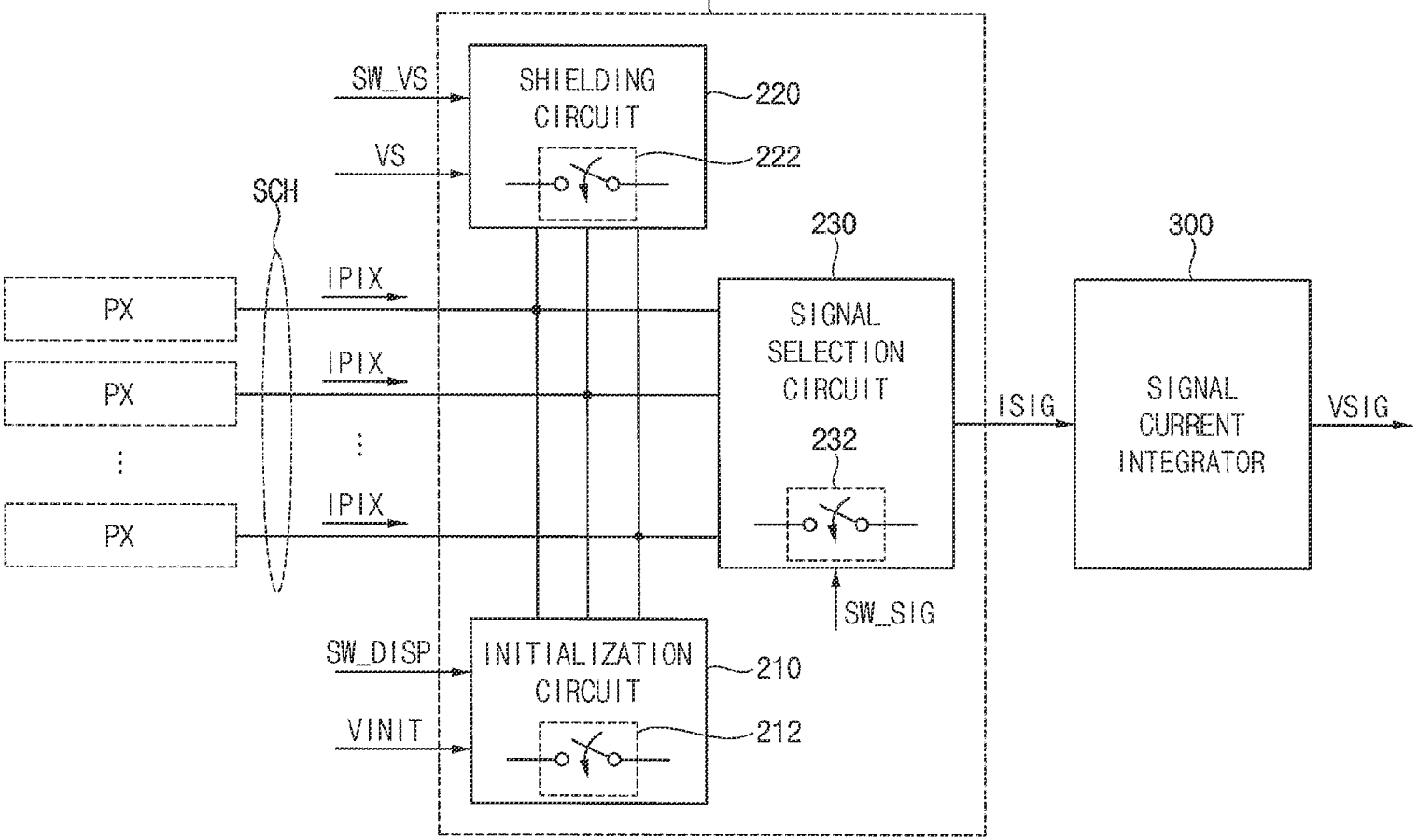
FIG. 1 is a block diagram illustrating a sensing circuit according to exemplary embodiments.

Various exemplary embodiments will be described more fully with reference to the accompanying drawings, in which embodiments are shown. The present disclosure may, however, be embodied in many different forms and should not be construed as limited to the embodiments set forth herein. Like reference numerals refer to like elements throughout this disclosure.

FIG. 1 is a block diagram illustrating a sensing circuit according to exemplary embodiments.

Referring to FIG. 1, a sensing circuit 100 includes a switch circuit 200 and a signal current integrator 300.

The sensing circuit 100 is connected to a plurality of pixels PX included in a display panel through a plurality of sensing channels SCH. The sensing circuit 100 detects characteristics of the plurality of pixels PX based on a plurality of pixel currents IPIX received through the plurality of sensing channels SCH and/or a plurality of sensing currents ISIG. For example, the sensing circuit 100 may be included in a display driver integrated circuit (DDI) that drives the display panel. Exemplary configurations of the display panel, the display driver integrated circuit and the plurality of pixels PX will be described with reference to FIGS. 2 and 3.

The switch circuit 200 controls the operation of applying voltages to the plurality of sensing channels SCH and/or controls the operation of outputting currents from the plurality of sensing channels SCH. The switch circuit 200 includes an initialization circuit 210, a shielding circuit (or a shield circuit) 220 and a signal selection circuit 230.

The initialization circuit 210 includes a plurality of initialization switches 212. The plurality of initialization switches 212 are connected to the plurality of sensing channels SCH, and apply an initialization voltage VINIT to the plurality of sensing channels SCH based on an initialization control signal SW_DISP. For example, the plurality of initialization switches 212 may be substantially simultaneously (or concurrently) turned on based on the initialization control signal SW_DISP, and the initialization voltage VINIT may be substantially simultaneously provided to the plurality of sensing channels SCH through the plurality of initialization switches 212.

The signal selection circuit 230 includes a plurality of signal selection switches 232. The plurality of signal selection switches 232 sequentially output the plurality of pixel currents IPIX received from the plurality of sensing channels SCH as the plurality of sensing currents ISIG based on a plurality of sensing control signals SW_SIG. For example, the plurality of signal selection switches 232 may be sequentially turned on based on the plurality of sensing control signals SW_SIG, and only one signal selection switch may be turned on at a specific point in time. The plurality of sensing currents ISIG may be sequentially provided to the signal current integrator 300. A sensing channel connected to a turned-on signal selection switch may be referred to as a target sensing channel that is a target of a sensing operation, and a sensing current provided from the target sensing channel among the plurality of sensing currents ISIG may be referred to as a target sensing current.

The shielding circuit 220 includes a plurality of shield switches 222. The plurality of shield switches 222 are connected to the plurality of sensing channels SCH, and apply a shield voltage VS different from the initialization voltage VINIT to the plurality of sensing channels SCH based on a plurality of shield control signals SW_VS. For example, the plurality of shield switches 222 may be turned on based on the plurality of shield control signals SW_VS, and only some of the shield switches 222 may be turned on at a specific point in time. A sensing channel connected to a turned-on shield switch may be referred to as a shield sensing channel for preventing or reducing the coupling noise that affects the target sensing channel during the sensing operation.

In some exemplary embodiments, when the target sensing current is to be detected from the target sensing channel from the plurality of sensing channels SCH, e.g., when it is desired to detect the target sensing current provided from the target sensing channel from the plurality of sensing channels SCH, at least one sensing channel adjacent to the target sensing channel may be selected or set as the shield sensing channel from the plurality of sensing channels SCH, and the plurality of shield switches 222 may be controlled such that the shield voltage VS is applied to the at least one shield sensing channel. For example, when the sensing operation is sequentially performed from the first sensing channel to the last sensing channel among the plurality of sensing channels SCH, e.g., when the target sensing channel is sequentially changed from the first sensing channel to the last sensing channel, the at least one shield sensing channel may also be sequentially changed to correspond to the change of the target sensing channel In other words, an active shielding scheme in which the shield sensing channel is actively or adaptively changed may be implemented.

In some exemplary embodiments, the number of the of sensing channels SCH, the number of the of initialization switches 212, the number of the of shield switches 222, and the number of signal selection switches 232 may be equal to one another. For example, one initialization switch, one shield switch and one signal selection switch may be connected to each sensing channel. However, exemplary embodiments are not limited thereto.

The signal current integrator 300 sequentially converts the sensing currents ISIG into a sensing voltages VSIG, and sequentially generates and outputs the sensing voltages VSIG. The one signal current integrator 300 may be shared by the number of sensing channels SCH.

An electroluminescent display panel, which includes a plurality of pixels each of which includes a light emitting element such as a light-emitting diode (LED) or an organic light-emitting diode (OLED) and a driving transistor for driving the light emitting element, may present a problem of luminance variation due to deviation between light emitting elements, deviation between driving transistors, and the like. In addition, characteristics of the light emitting elements and characteristics of the driving transistors (e.g., mobility, threshold voltage, etc.) may be deteriorated or degraded (e.g., burn-in) as the amount of usage time increases, and an image permanence or ghosting phenomenon may occur in which an often-used image form permanently appears on a screen due to the deterioration. Such luminance variation or image permanence may be reduced by compensating the threshold voltage of the driving transistor inside or outside the display panel. It is possible to directly measure and compensate the luminance variation of pixels while the display device is manufactured. However, to compensate the deterioration of the light emitting element over usage time after the display device is manufactured and delivered to an end user, it may be necessary to continuously sense or detect the degree of direct deterioration that has occurred.

Conventionally, a method of measuring a voltage without a current integrator has been used. However, since a relatively fast measurement can be performed when using a current integrator that directly reads a current from the driving transistor, it is necessary to simultaneously measure the current and the voltage for detecting the degradation, the current integrator for current measurement has been used. For multi-channel current measurement, there is a problem in that a chip size increases if the current integrator is placed on each channel. Thus, to reduce the chip size, a serial current measurement scheme in which a plurality of pixels connected to a plurality of channels are sequentially measured in time using one integrator has been used. In the serial current measurement scheme, the measurement operation may be sequentially performed by sequentially driving from the first measurement channel to the last measurement channel, and the coupling noise from adjacent (n−1)-th and/or (n+1)-th sensing channels may be generated while an n-th measurement channel is driving, resulting in a channel offset on outputs from the current integrator.

The sensing circuit 100 according to exemplary embodiments may be implemented based on the serial current sensing scheme in which the sensing operation is sequentially performed on the plurality of sensing channels SCH using one signal current integrator 300. In addition, the sensing circuit 100 may be implemented based on the active shielding scheme in which the at least one sensing channel adjacent to the target sensing channel is selected or set as the shield sensing channel during the sensing operation for the target sensing channel, the shield voltage VS is applied to the at least one shield sensing channel, and the at least one shield sensing channel is sequentially changed to correspond to the change of the target sensing channel. Accordingly, the coupling noise from an adjacent sensing channel may be efficiently prevented or reduced, and the sensing performance and accuracy may be improved and enhanced.

Figure 2:
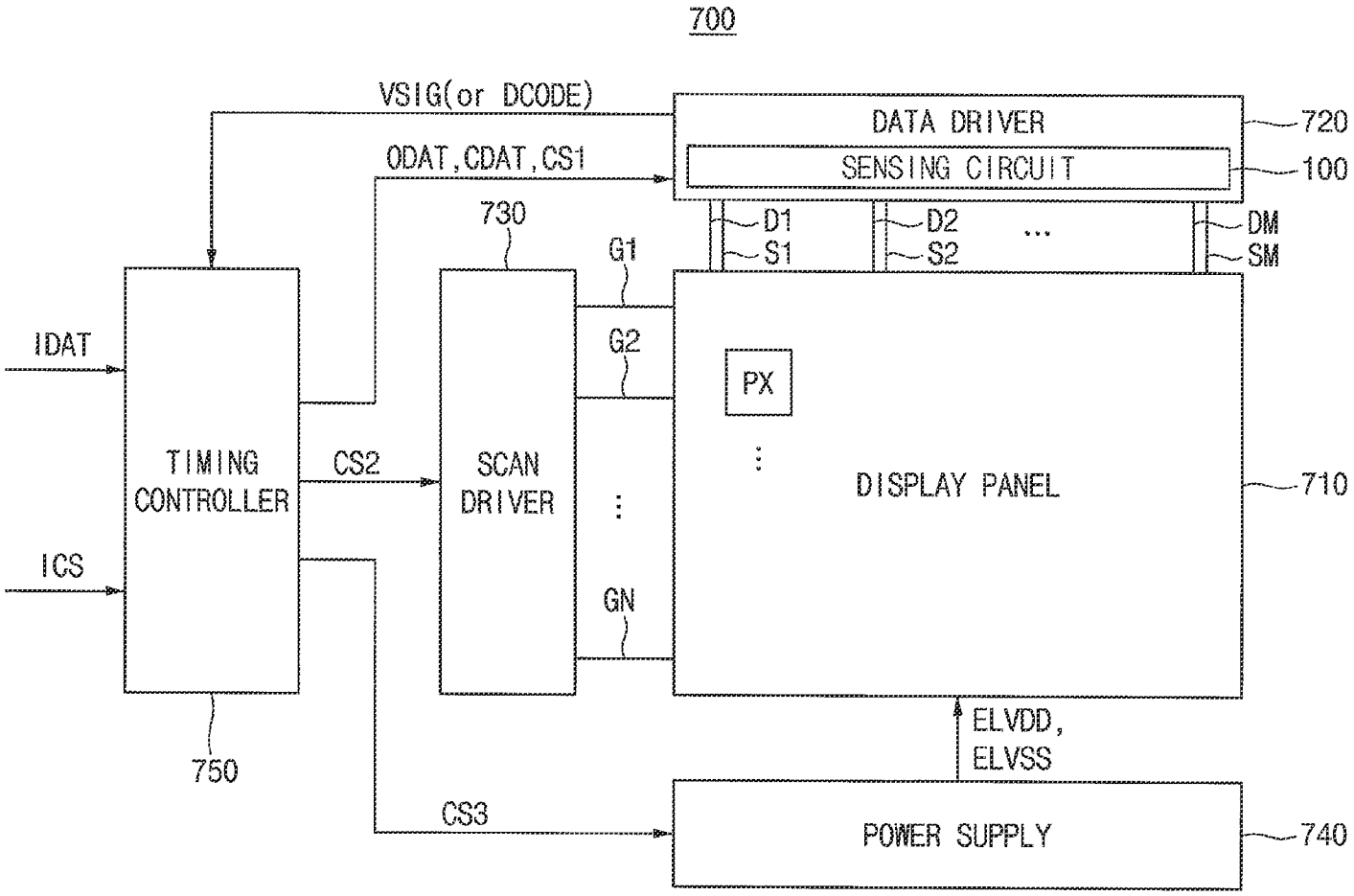
FIG. 2 is a block diagram illustrating a display driver integrated circuit and a display device including the display driver integrated circuit according to exemplary embodiments.

FIG. 2 is a block diagram illustrating a display driver integrated circuit and a display device including the display driver integrated circuit according to exemplary embodiments.

Referring to FIG. 2, a display device 700 includes a display panel 710 and a display driver integrated circuit. The display driver integrated circuit may include a data driver 720, a scan driver 730, a power supply 740 and a timing controller 750. In other words, elements other than the display panel 710 among all elements illustrated in FIG. 2 may form the display driver integrated circuit.

The display panel 710 may operate (e.g., display an image) based on image data (e.g., frame data). The display panel 710 may be connected to the data driver 720 through a plurality of data lines D1, D2, . . . , DM and a plurality of sensing lines S1, S2, SM, and may be connected to the scan driver 730 through a plurality of scan lines (or gate lines) G1, G2, . . . , GN. The plurality of data lines D1 to DM and the plurality of sensing lines S1 to SM may extend in a first direction, and the plurality of scan lines G1 to GN may extend in a second crossing direction with respect to (e.g., substantially perpendicular to) the first direction.

The display panel 710 may include a plurality of pixels PX arranged in a matrix having a plurality of rows and a plurality of columns. For example, each of the plurality of pixels PX may include a light emitting element and at least one driving transistor for driving the light emitting element. Each of the plurality of pixels PX may be electrically connected to a respective one of the plurality of data lines D1 to DM, a respective one of the plurality of sensing lines S1 to SM and a respective one of the plurality of scan lines G1 to GN.

In some exemplary embodiments, the display panel 710 may be a self-emitting display panel that emits light without the use of a backlight unit. For example, the display panel 710 may be an organic light-emitting diode (OLED) display panel including an OLED as the light emitting element.

In some exemplary embodiments, each of the plurality of pixels PX included in the display panel 710 may have various configurations according to a driving scheme of the display device 700. For example, the display device 700 may be driven with an analog or a digital driving scheme. While an analog driving scheme produces grayscale using variable voltage levels corresponding to input data, the digital driving scheme produces grayscale using a variable time duration in which a light-emitting diode (LED) emits light. The analog driving scheme is difficult to implement because it requires a driving integrated circuit (IC) that is complicated to manufacture if the display is large and requires high resolution. The digital driving scheme, on the other hand, can readily accomplish the required high resolution with a simpler IC structure. An example structure of each pixel PX will be described with reference to FIG. 3.

The data driver 720 may generate a plurality of data voltages based on output image data ODAT and a control signal CS1, and may apply the plurality of data voltages to the plurality of pixels PX included in the display panel 710 through the plurality of data lines D1 to DM. For example, the data driver 720 may include a digital-to-analog converter (DAC) that converts the output image data ODAT in a digital form into the plurality of data voltages in an analog form. Additional compensation data CDAT may be used by the data driver 720 to generate the plurality of data voltages.

The data driver 720 includes a sensing circuit 100. The sensing circuit 100 may be the sensing circuit 100 of FIG. 1. The sensing circuit 100 may be connected to the plurality of pixels PX through the plurality of sensing lines S1 to SM, may detect characteristics of the plurality of pixels PX based on the plurality of pixel currents IPIX received through the plurality of sensing lines S1 to SM and/or the plurality of sensing currents ISIG, and may generate and output the plurality of sensing voltages VSIG representing the characteristics of the plurality of pixels PX. The plurality of sensing lines S1 to SM may correspond to the plurality of sensing channels SCH in FIG. 1. In some exemplary embodiments, the sensing circuit 100 may further include an analog-to-digital converter (ADC) as will be described with reference to FIG. 15, and the sensing circuit 100 may generate and output a plurality of digital codes DCODE corresponding to the plurality of sensing voltages VSIG.

Although FIG. 2 illustrates that the sensing circuit 100 is included in the data driver 720, exemplary embodiments are not limited thereto. For example, the sensing circuit 100 may be disposed or located at any position in the display driver integrated circuit.

Although FIG. 2 illustrates that the display driver integrated circuit includes one sensing circuit 100, exemplary embodiments are not limited thereto. For example, the display driver integrated circuit may include two or more sensing circuits. For example, when the display driver integrated circuit includes two or more sensing circuits, the plurality of sensing lines S1 to SM may be divided into two or more sensing line groups each of which includes at least one sensing line, and one sensing circuit may be connected to sensing lines included in one sensing line group to perform the above-described operation of detecting the characteristics of the plurality of pixels PX.

The scan driver 730 may generate a plurality of scan signals based on a control signal CS2, and may apply the plurality of scan signals to the plurality of pixels PX included in the display panel 710 through the plurality of scan lines G1 to GN. The plurality of scan lines G1 to GN may be sequentially activated based on the plurality of scan signals.

The timing controller 750 may control overall operations of the display device 700. For example, the timing controller 750 may receive an input control signal ICS from outside (e.g., from an external display processor), and may provide the control signals CS1, CS2 and CS3 to the data driver 720, the scan driver 730 and the power supply 740 based on the input control signal ICS to control the operations of the display device 700. For example, the control signals CS1, CS2 and CS3 may include a vertical synchronization signal and a horizontal synchronization signal that are used inside the display device 700.

The timing controller 750 may receive input image data IDAT from outside, and may generate the output image data ODAT for displaying an image based on the input image data IDAT. For example, the input image data IDAT may include red image data, green image data and blue image data. In addition, the input image data IDAT may include white image data. Alternatively, the input image data IDAT may include magenta image data, yellow image data, cyan image data, or the like.

The timing controller 750 may generate the compensation data CDAT used to compensate deterioration associated with the characteristics of the plurality of pixels PX based on the plurality of sensing voltages VSIG (or based on the plurality of digital codes DCODE). The display quality may be improved or enhanced using the plurality of data voltages generated based on the output image data ODAT and the compensation data CDAT.

In some exemplary embodiments, the data driver 720, the scan driver 730 and the timing controller 750 may be implemented as one integrated circuit. In other example embodiments, the data driver 720, the scan driver 730 and the timing controller 750 may be implemented as two or more integrated circuits. A driving module including at least the timing controller 750 and the data driver 720 may be referred to as a timing controller embedded data driver (TED).

The power supply 740 may supply a first power supply voltage ELVDD and a second power supply voltage ELVSS to the display panel 710 based on the control signal CS3. For example, the first power supply voltage ELVDD may be a high power supply voltage, and the second power supply voltage ELVSS may be a low power supply voltage.

In some exemplary embodiments, at least some of the elements included in the display driver integrated circuit may be disposed, e.g., directly mounted, on the display panel 710, or may be connected to the display panel 710 in a tape carrier package (TCP). Alternatively, at least some of the elements included in the display driver integrated circuit may be integrated on the display panel 710. In some exemplary embodiments, the elements included in the display driver integrated circuit may be respectively implemented with separate circuits/modules/chips. In other exemplary embodiments, on the basis of function, some of the elements included in the display driver integrated circuit may be combined into one circuit/module/chip, or may be further separated into a plurality of circuits/modules/chips.

Although not illustrated in detail, the display device 700 may further include a frame buffer for storing image data, etc. depending on a type of the pixels PX, a driving scheme of the display panel 710, etc.

Figure 3:
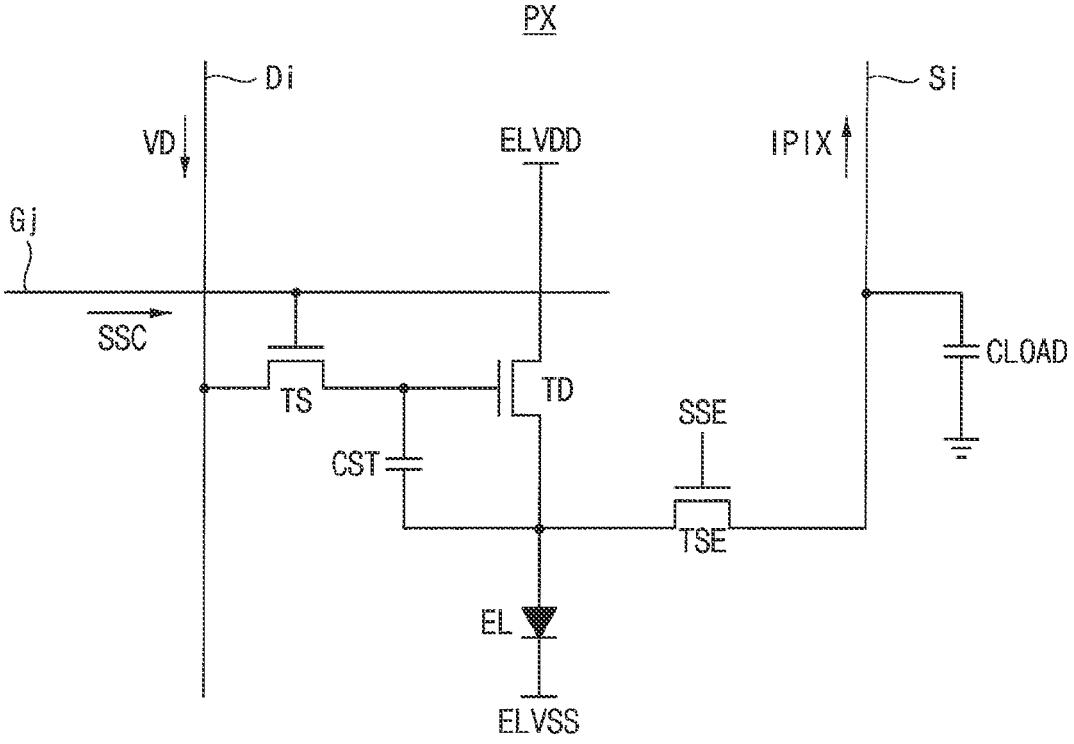
FIG. 3 is a circuit diagram illustrating an example of a pixel included in a display panel included in a display device of FIG. 2.

FIG. 3 is a circuit diagram illustrating an example of a pixel included in a display panel included in a display device of FIG. 2.

Referring to FIG. 3, a pixel PX may include a switching transistor TS, a storage capacitor CST, a driving transistor TD, a sensing transistor TSE, an organic light-emitting diode EL and a load capacitor CLOAD.

The switching transistor TS may have a first electrode connected to a data line Di, a second electrode connected to the storage capacitor CST, and a gate electrode connected to a scan line Gj. The switching transistor TS may transfer a data voltage VD received from the data driver 720 to the storage capacitor CST in response to a scan signal SSC received from the scan driver 730.

The storage capacitor CST may have a first electrode connected to a gate electrode of the driving transistor TD, and a second electrode connected to the organic light-emitting diode EL. The storage capacitor CST may store the data voltage VD transferred through the switching transistor TS.

The driving transistor TD may have a first electrode connected to the first power supply voltage ELVDD, a second electrode connected to the organic light-emitting diode EL, and the gate electrode connected to the storage capacitor CST. The driving transistor TD may be turned on or off depending on the data voltage VD stored in the storage capacitor CST.

The organic light-emitting diode EL may have an anode electrode connected to the driving transistor TD and the storage capacitor CST, and a cathode electrode connected to the second power supply voltage ELVSS. The organic light-emitting diode EL may emit light based on a current flowing from the first power supply voltage ELVDD to the second power supply voltage ELVSS while the driving transistor TD is turned on. The brightness of the pixel PX may increase as the current flowing through the organic light-emitting diode EL increases.

The sensing transistor TSE may have a first electrode connected to the organic light-emitting diode EL, a gate electrode receiving a sensing control signal SSE, and a second electrode connected to a sensing line Si and the load capacitor CLOAD. The sensing transistor TSE may provide the initialization voltage VINIT or the shield voltage VS, or may output the pixel current IPIX in response to the sensing control signal SSE.

In some exemplary embodiments, the gate electrode of the sensing transistor TSE may be connected to one of the plurality of scan lines G1 to GN. In other words, the sensing control signal SSE may be generated and provided by the scan driver 730. For example, a scan line connected to the gate electrode of the sensing transistor TSE may be the same as or different from the scan line Gj connected to the gate electrode of the switching transistor TS.

Unlike the storage capacitor CST, the load capacitor CLOAD may be a parasitic capacitor formed between the sensing line Si and a ground voltage. The second electrode of the driving transistor TD may be charged during the sensing operation by the load capacitor CLOAD and the initialization voltage VINIT.

Although FIG. 3 illustrates an example of the pixel PX that is included in the display panel 710, it would be understood that exemplary embodiments are not limited thereto and other embodiments may be applied to any pixels of various types and configurations.

Figure 4:
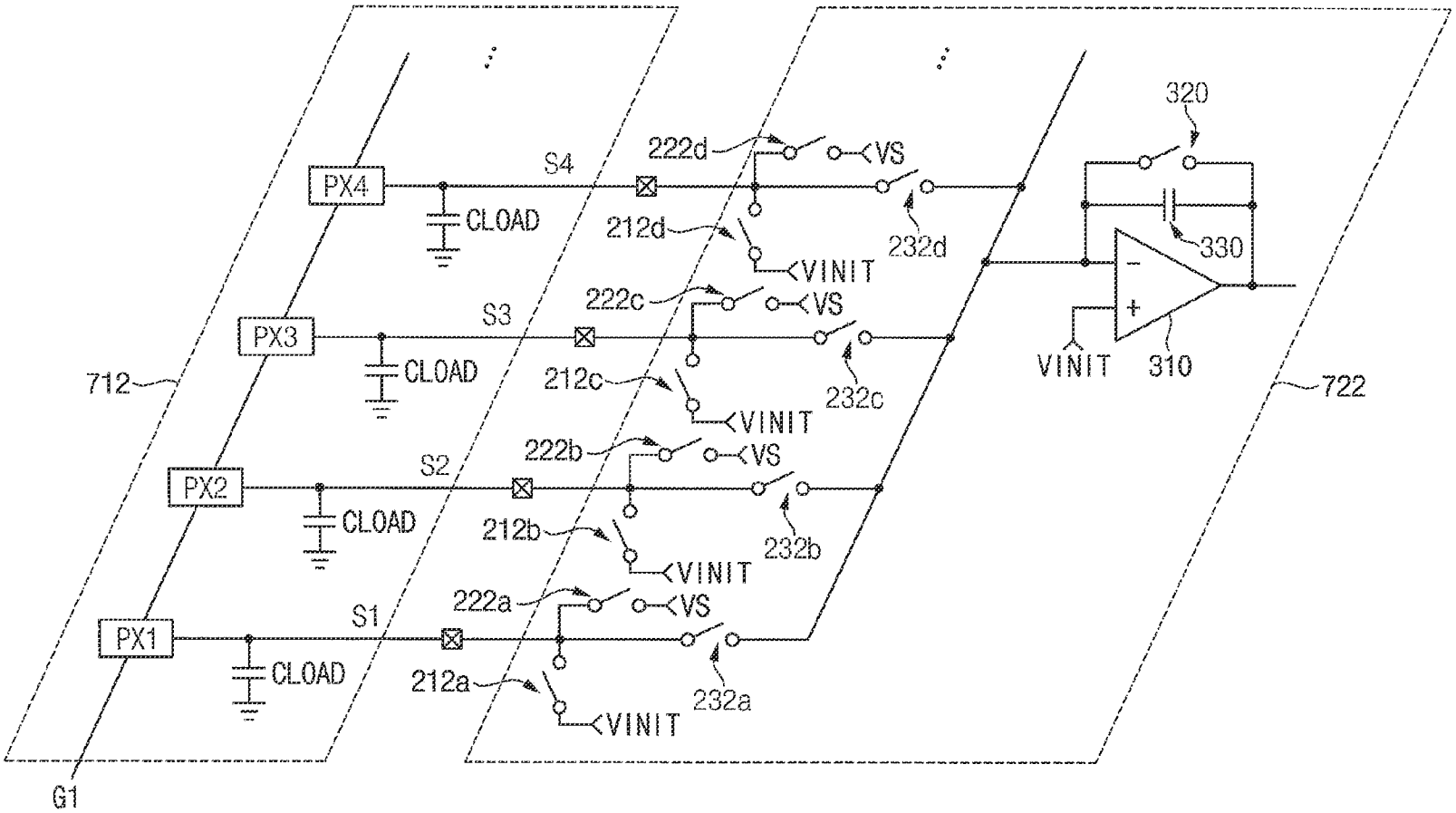
FIG. 4 is a circuit diagram illustrating an example of a sensing circuit of FIG. 1.

FIG. 4 is a circuit diagram illustrating an example of a sensing circuit of FIG. 1.

Referring to FIG. 4, a sensing circuit may be included in a data driver 722, and may be connected to pixels and sensing lines included in a display panel 712. For convenience of illustration, only a portion in which the sensing circuit is connected to four pixels and four sensing lines is illustrated.

First, second, third and fourth pixels PX1, PX2, PX3 and PX4 may be commonly connected to a first scan line G1, and may be connected to first, second, third and fourth sensing lines S1, S2, S3 and S4, respectively. For example, each of the first to fourth pixels PX1 to PX4 may have a configuration illustrated in FIG. 3, and the gate electrode of the sensing transistor TSE may be connected to the first scan line G1. When the sensing operation is performed, the sensing transistor TSE may be turned on in response to the sensing control signal SSE applied through the first scan line G1.

The sensing circuit may include first, second, third and fourth initialization switches 212*a*, 212*b*, 212*c* and 212*d*, first, second, third and fourth shield switches 222*a*, 222*b*, 222*c* and 222*d*, first, second, third and fourth signal selection switches 232*a*, 232*b*, 232*c* and 232*d*, an operational amplifier 310, a reset switch 320, and a feedback capacitor 330.

The first initialization switch 212*a* may be connected between the first sensing line S1 and the initialization voltage VINIT. The second initialization switch 212*b* may be connected between the second sensing line S2 and the initialization voltage VINIT. The third initialization switch 212*c* may be connected between the third sensing line S3 and the initialization voltage VINIT. The fourth initialization switch 212*d* may be connected between the fourth sensing line S4 and the initialization voltage VINIT.

The first shield switch 222*a* may be connected between the first sensing line S1 and the shield voltage VS. The second shield switch 222*b* may be connected between the second sensing line S2 and the shield voltage VS. The third shield switch 222*c* may be connected between the third sensing line S3 and the shield voltage VS. The fourth shield switch 222*d* may be connected between the fourth sensing line S4 and the shield voltage VS.

The first signal selection switch 232*a* may be connected between the first sensing line S1 and a first input terminal (e.g., a negative (−) input terminal) of the operational amplifier 310. The second signal selection switch 232*b* may be connected between the second sensing line S2 and the first input terminal of the operational amplifier 310. The third signal selection switch 232*c* may be connected between the third sensing line S3 and the first input terminal of the operational amplifier 310. The fourth signal selection switch 232*d* may be connected between the fourth sensing line S4 and the first input terminal of the operational amplifier 310.

The operational amplifier 310 may include the first input terminal connected to the first to fourth signal selection switches 232*a* to 232*d* to sequentially receive the plurality of sensing currents ISIG, a second input terminal (e.g., a positive (+) input terminal) receiving the initialization voltage VINIT, and an output terminal sequentially outputting the plurality of sensing voltages VSIG. The reset switch 320 may be connected between the first input terminal and the output terminal of the operational amplifier 310. The feedback capacitor 330 may be connected in parallel with the reset switch 320 between the first input terminal and the output terminal of the operational amplifier 310. The operational amplifier 310, the reset switch 320 and the feedback capacitor 330 may embody the signal current integrator 300 in FIG. 1.

FIGS. 5A, 5B, 5C, 5D and 5E are diagrams for describing an operation of a sensing circuit of FIG. 4.

Figure 5A:
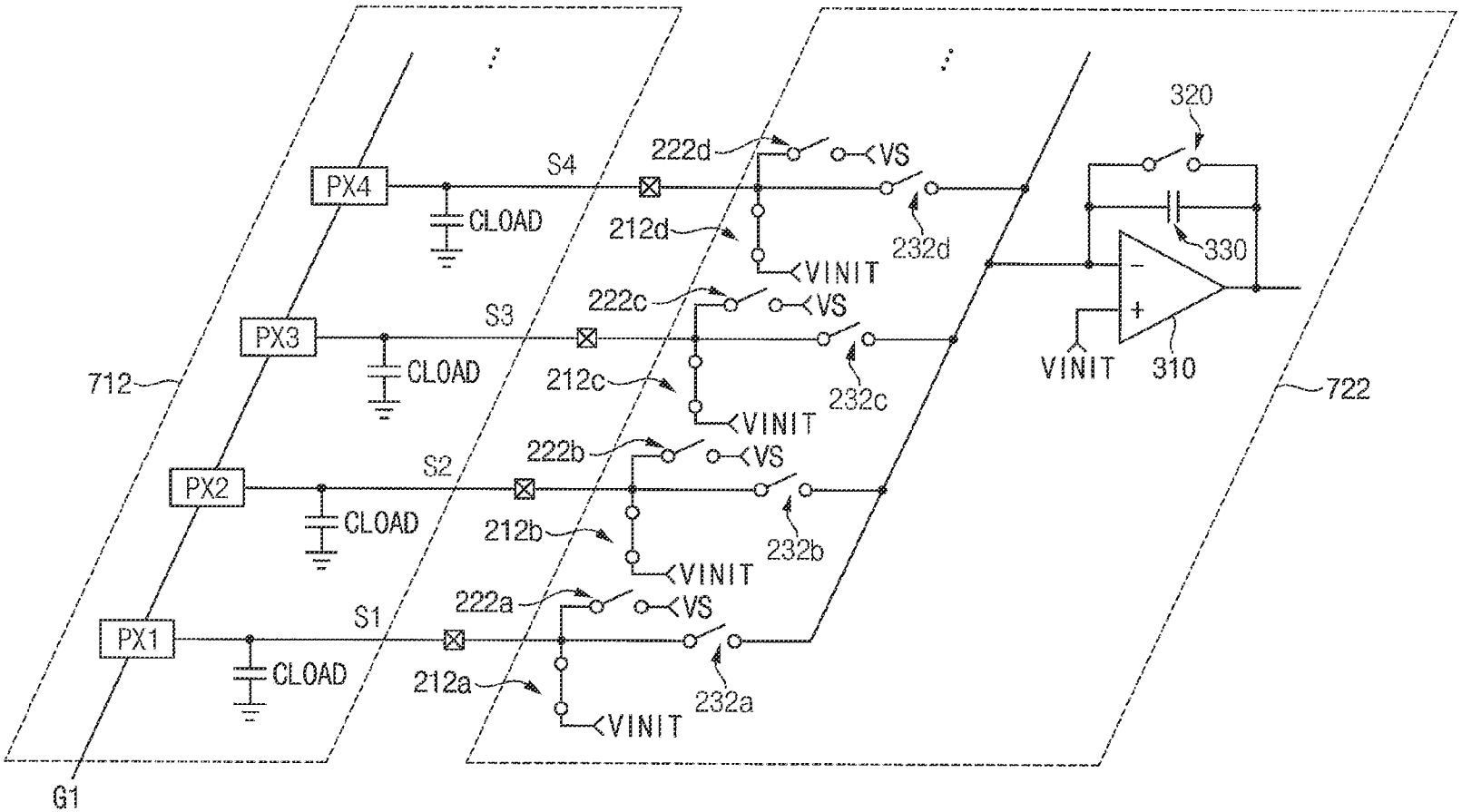
FIGS. 5A, 5B, 5C, 5D and 5E are diagrams for describing an operation of a sensing circuit of FIG. 4.
Figure 5B:
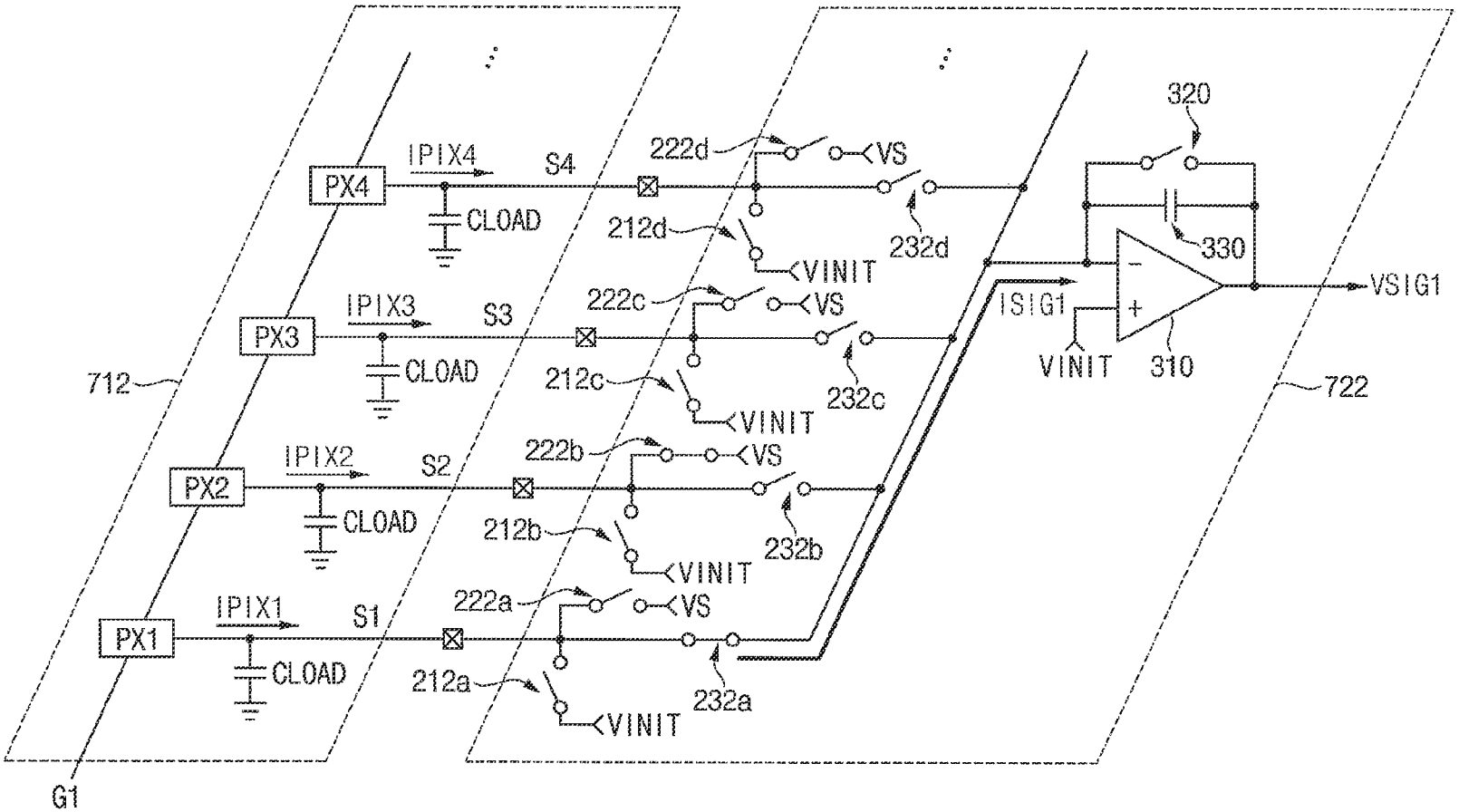
Figure 5C:
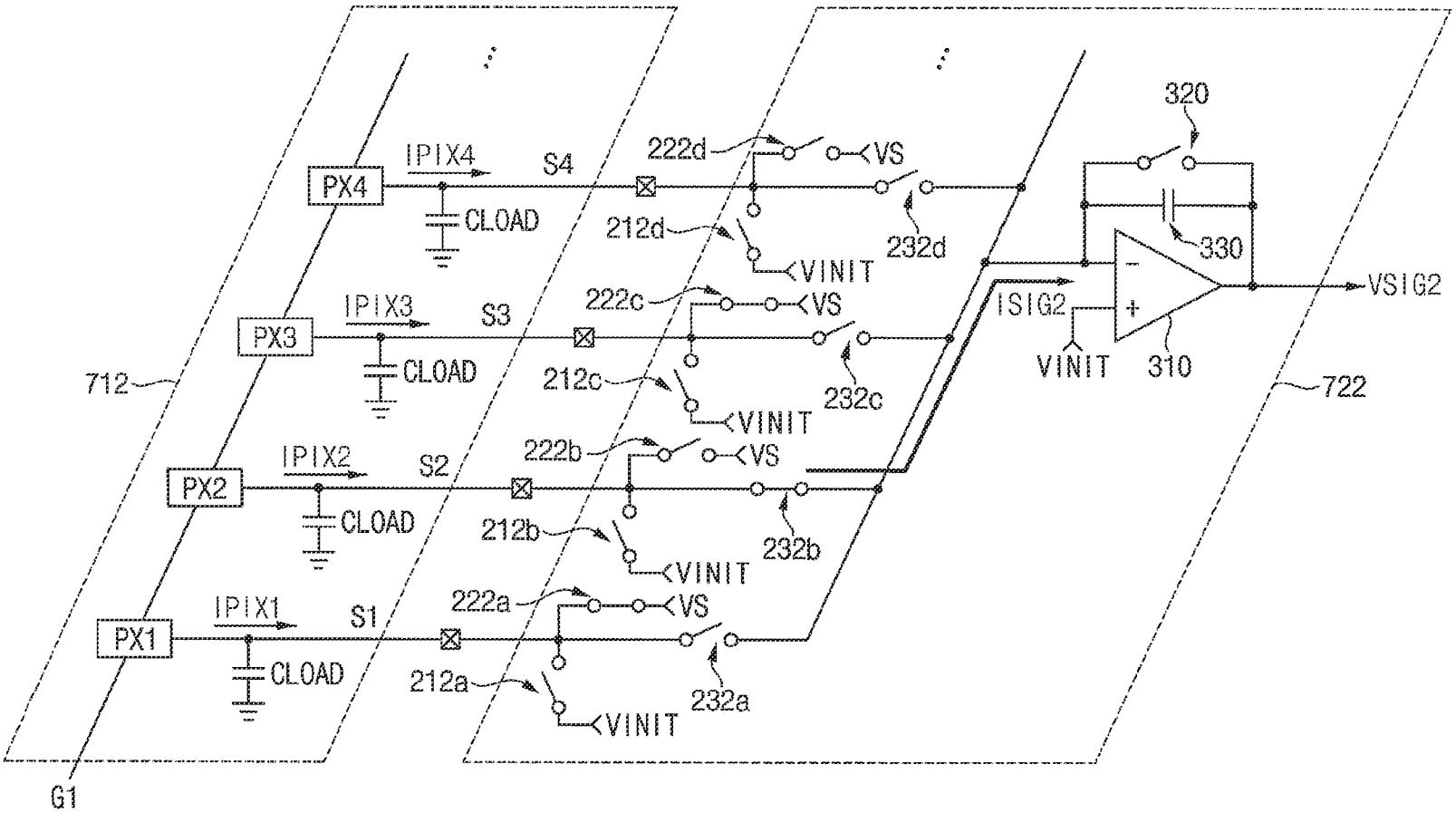
Figure 5D:
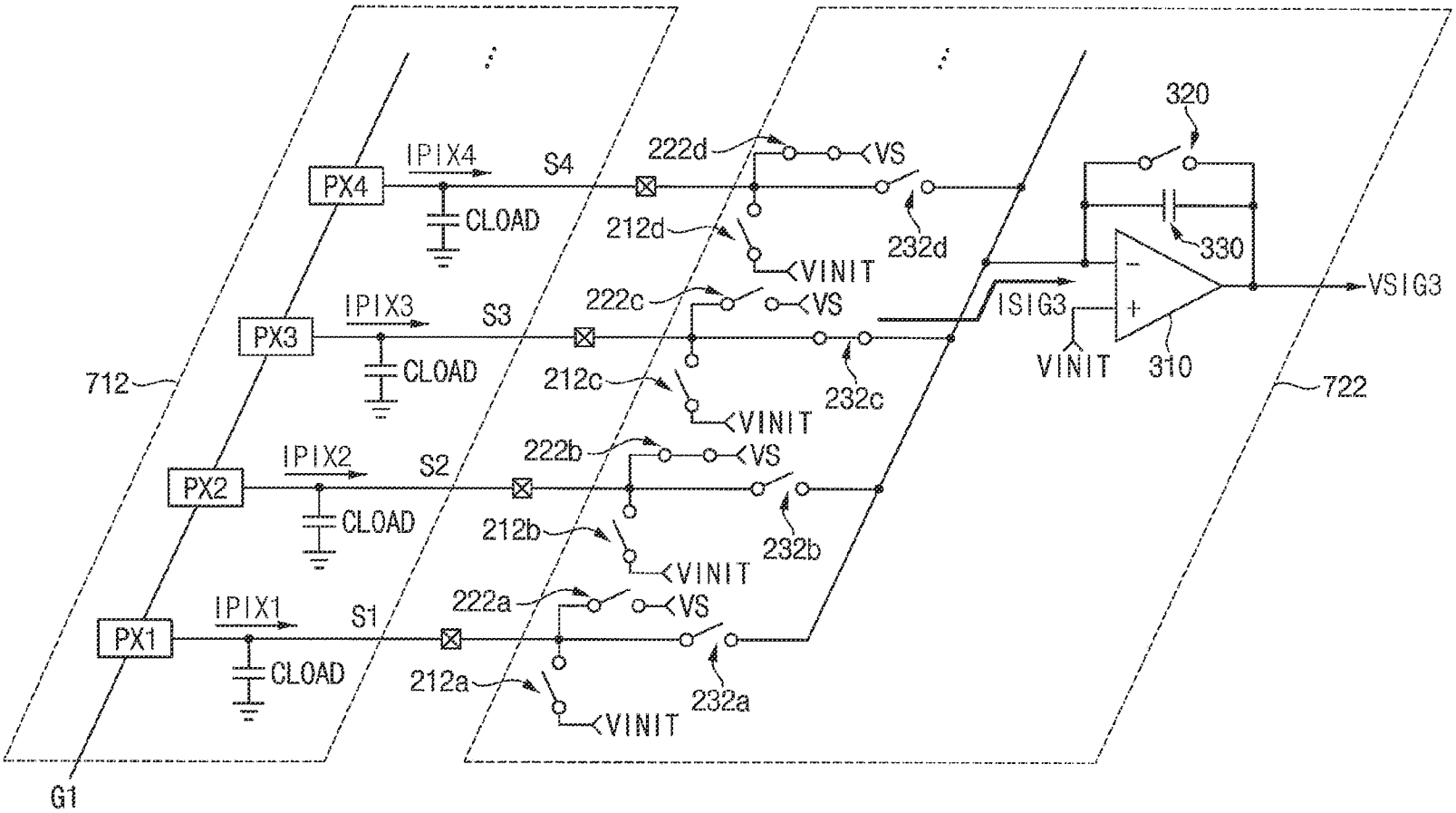
Figure 5E:
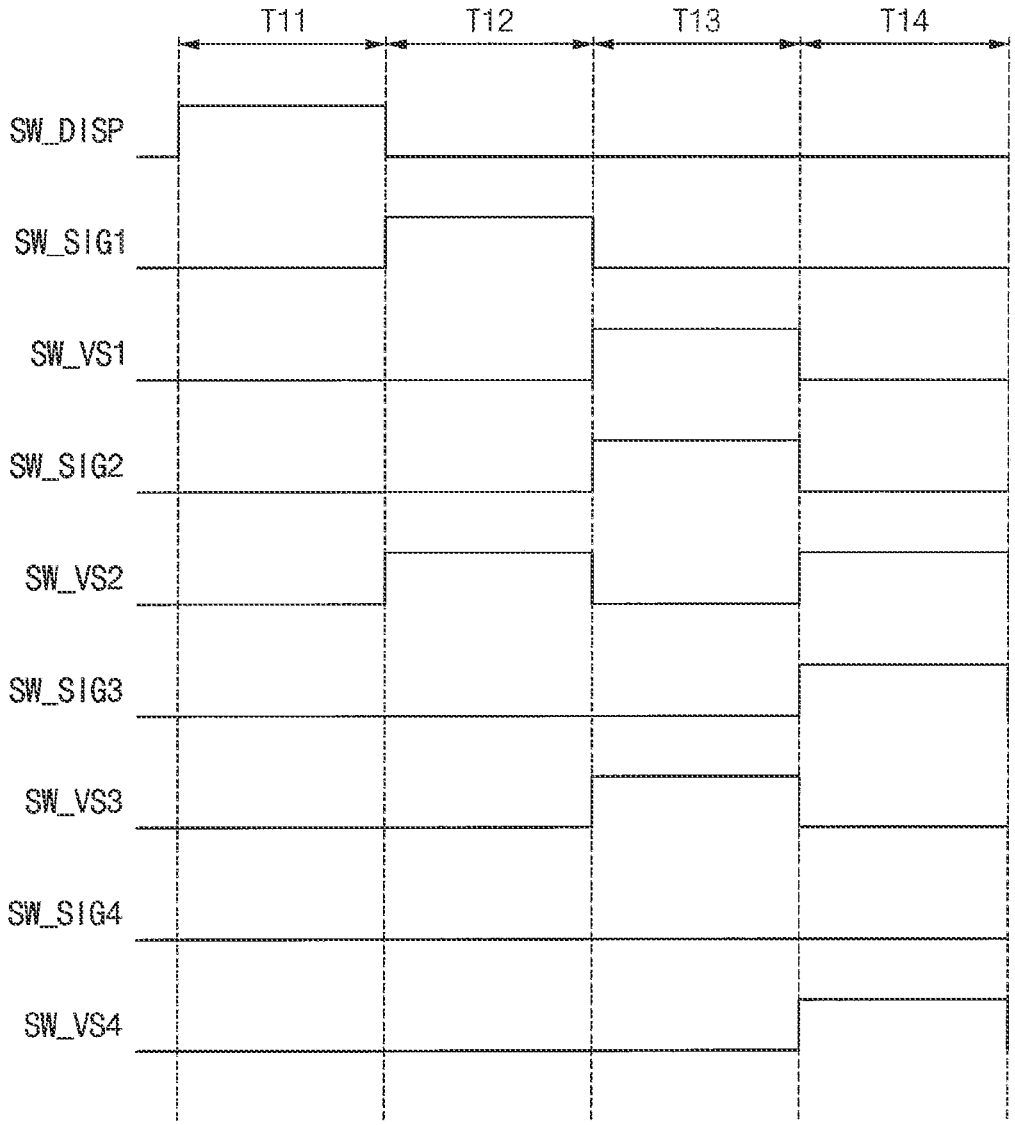

In FIG. 5E, "SW_DISP" represents the initialization control signal applied to the first to fourth initialization switches 212*a* to 212*d*, "SW_VS1", "SW_VS2", "SW_VS3" and "SW_VS4" represent first, second, third and fourth shield control signals applied to the first to fourth shield switches 222*a* to 222*d*, respectively, and "SW_SIG1", "SW_SIG2", "SW_SIG3" and "SW_SIG4" represent first, second, third and fourth sensing control signals applied to the first to fourth signal selection switches 232*a* to 232*d*, respectively.

Referring to FIGS. 5A, 5B, 5C, 5D and 5E, an example in which one sensing channel adjacent to the target sensing channel in a first direction and one sensing channel adjacent to the target sensing channel in a second direction are selected or set as the shield sensing channels is illustrated.

In other words, the plurality of sensing channels SCH may include a first sensing channel to an X-th sensing channel, where X is a natural number greater than or equal to three. When a K-th sensing channel is selected or set as the target sensing channel from among the first to X-th sensing channels, where K is a natural number greater than or equal to two and less than or equal to (X−1), a (K−1)-th sensing channel and a (K+1)-th sensing channel may be selected or set as the at least one shield sensing channel from the first to X-th sensing channels.

In addition, the plurality of signal selection switches 232 may include a K-th signal selection switch connected to the K-th sensing channel, and the plurality of shield switches 222 may include a (K−1)-th shield switch connected to the (K−1)-th sensing channel and a (K+1)-th shield switch connected to the (K+1)-th sensing channel. A K-th sensing current received from the K-th sensing channel among the plurality of sensing currents ISIG may be provided to the signal current integrator 300 by turning on the K-th signal selection switch. While the K-th signal selection switch is turned on, the shield voltage VS may be applied to the (K−1)-th sensing channel and the (K+1)-th sensing channel by turning on both the (K−1)-th shield switch and the (K+1)-th shield switch.

Further, a K-th sensing control signal among the plurality of sensing control signals SW_SIG may be activated to turn on the K-th signal selection switch. While the K-th sensing control signal is activated, both a (K−1)-th shield control signal and a (K+1)-th shield control signal among the plurality of shield control signals SW_VS may be activated to turn on both the (K−1)-th shield switch and the (K+1)-th shield switch.

For example, as illustrated in FIGS. 5A and 5E, the first to fourth initialization switches 212*a* to 212*d* may be turned on by activating the initialization control signal SW_DISP during a first time interval T11, and the first to fourth sensing lines S1 to S4 may be initialized with the initialization voltage VINIT.

During the first time interval T11, a constant data voltage (e.g., VD in FIG. 3) may be applied to the gate electrode of a driving transistor (e.g., TD in FIG. 3) in each pixel, a voltage between the gate electrode and a source electrode of the driving transistor TD may be maintained constant (e.g., VGS=VD-VINIT), and thus, a constant current may be generated and output from the driving transistor TD. For example, as illustrated in FIGS. 5B, 5C and 5D, first, second, third and fourth pixel currents IPIX1, IPIX2, IPIX3 and IPIX4 may be output from the first to fourth pixels PX1 to PX4, respectively.

After that, as illustrated in FIGS. 5B and 5E, the initialization control signal SW_DISP may be deactivated after the first time interval T11. During a second time interval T12 after the first time interval T11, the first signal selection switch 232*a* may be turned on by activating the first sensing control signal SW_SIG1, and the first sensing line S1 may be electrically connected to the first input terminal of the operational amplifier 310. In addition, during the second time interval T12, the second shield switch 222*b* may be turned on by activating the second shield control signal SW_VS2, and the shield voltage VS may be applied to the second sensing line S2. In other words, in the second period T12, the first sensing line S1 may be selected or set as the target sensing channel, and the second sensing line S2 may be selected or set as the shield sensing channel Only the second sensing line S2 may be set as the shield sensing channel for the first sensing line S1.

During the second time interval T12, the first pixel current IPIX1 received through the first sensing line S1 may be provided to the first input terminal of the operational amplifier 310 as a first sensing current ISIG1. The reset switch 320 may be turned on to reset the signal current integrator 300, and then the reset switch 320 may be turned off to start a current integration with respect to the first sensing current ISIG1. The first sensing current ISIG1 may be converted into a first sensing voltage VSIG1 by the current integration. The first sensing voltage VSIG1 may represent a characteristic of the first pixel PIX1.

After that, as illustrated in FIGS. 5C and 5E, the first sensing control signal SW_SIG1 and the second shield control signal SW_VS2 may be deactivated after the second time interval T12. During a third time interval T13 after the second time interval T12, the second signal selection switch 232*b* and the first and third shield switches 222*a* and 222*c* may be turned on by activating the second sensing control signal SW_SIG2 and the first and third shield control signals SW_VS1 and SW_VS3. The second sensing line S2 may be selected or set as the target sensing channel, and the first and third sensing lines S1 and S3 may be selected or set as the shield sensing channels. In addition, during the third time interval T13, the second pixel current IPIX2 received through the second sensing line S2 may be provided as a second sensing current ISIG2, and the second sensing current ISIG2 may be converted into a second sensing voltage VSIG2 by performing the current integration.

Similarly, as illustrated in FIGS. 5D and 5E, the second sensing control signal SW_SIG2 and the first and third shield control signals SW_VS1 and SW_VS3 may be deactivated after the third time interval T13. During a fourth time interval T14 after the third time interval T13, the third signal selection switch 232*c* and the second and fourth shield switches 222*b* and 222*d* may be turned on by activating the third sensing control signal SW_SIG3 and the second and fourth shield control signals SW_VS2 and SW_VS4. The third sensing line S3 may be selected or set as the target sensing channel, and the second and fourth sensing lines S2 and S4 may be selected or set as the shield sensing channels. In addition, during the fourth time interval T14, the third pixel current IPIX3 received through the third sensing line S3 may be provided as a third sensing current ISIG3, and the third sensing current ISIG3 may be converted into a third sensing voltage VSIG3 by performing the current integration.

In the above-described manner, the sensing operation may be sequentially performed from the first sensing line S1 to the X-th sensing line that is the last sensing line. As with the first sensing line S1, when the X-th sensing line is selected or set as the target sensing channel, only an (X−1)-th sensing line may be selected or set as the shield sensing channel.

In addition, after the sensing operation is performed on the pixels connected to the first scan line G1 in the above-described manner, sensing operations may be sequentially performed on pixels connected to the remaining scan lines (e.g., the scan lines G2 to GN). As a result, the sensing operations for all of the plurality of pixels PX may be sequentially performed and completed.

The coupling noise will be described based on FIG. 5C. When the second sensing line S2 is selected or set as the target sensing channel, the second sensing line S2 may be connected to the first input terminal of the signal current integrator 300, e.g., the operational amplifier 310, and thus a voltage level on the second sensing line S2 may be maintained constant. In contrast, the first and third sensing lines S1 and S3 adjacent to the second sensing line S2 may be floated, and thus the load capacitor CLOAD, which is a parasitic capacitance component of the first and third sensing lines S1 and S3, may be charged when the first and third pixel currents IPIX1 and IPIX3 are received from the first and third pixels PX1 and PX3. In this case, voltage levels on the first and third sensing lines S1 and S3 may continue to increase, and accordingly, coupling noise may occur due to a coupling capacitance of the second sensing line S2. If coupling noise occurs, the output noise may occur on an output of the integrator (e.g., the signal current integrator 300), and thus the performance of the integrator may be degraded or deteriorated. For example, since a feedback factor β for determining the closed-loop gain of the integrator is small and the integrator is sensitive to the input noise, a signal-to-noise ratio (SNR) of the integrator may be degraded or deteriorated. The effective noise bandwidth (ENBW) of the integrator may be obtained based on Equation 1, Equation 2 and Equation 3.

$$\overline{v_{n,output}^2} \approx |v_{n,input}(f)|^2 * \frac{w_{3dB} * A_o}{4 * \beta} \quad \left(t \gg \frac{\tau}{2}\right) \qquad \text{[Equation 1]}$$

$$ENBW(t) = \frac{w_{3dB} * A_o}{4 * \beta} = \frac{BW}{4 * \beta} \quad \left(t \gg \frac{\tau}{2}\right) \qquad \text{[Equation 2]}$$

$$\tau = \frac{1}{w_{3dB}(1 + A_o * \beta)} \qquad \text{[Equation 3]}$$

In Equation 1, Equation 2 and Equation 3, $A_O$ denotes the open-loop gain of the integrator, $W_{3dB}$ denotes the 3 dB frequency of the integrator, $\beta = C_F/(C_F + C_L)$, $C_L$ denotes a parasitic capacitance of the sensing line, and $C_F$ denotes a capacitance of the feedback capacitor 330.

It can be seen that the output noise distribution is inversely proportional to the feedback factor β. Since $C_L$ represents the parasitic capacitance of the sensing line, it may have a relatively large value. In contrast, since $C_F$ has a smaller value than $C_L$, the input noise may significantly affect the SNR performance. Therefore, when the second sensing line S2 is driven, the first and third sensing lines S1 and S3 adjacent to the second sensing line S2 may be maintained or held to the shield voltage VS to remove the coupling noise from an adjacent sensing line. The shield voltage VS may be used as a voltage separate from the initialization voltage VINIT because the initialization voltage VINIT is connected to the second input terminal of the operational amplifier 310 and the output noise also occurs on the output of the integrator when the initialization voltage VINIT fluctuates.

In some exemplary embodiments, a voltage level of the shield voltage VS may be substantially equal to a voltage level of the initialization voltage VINIT. In other words, the shield voltage VS and the initialization voltage VINIT may be different voltages, but may also have the same voltage level. However, exemplary embodiments are not limited thereto, and the voltage level of the initialization voltage VINIT and the voltage level of the shield voltage VS may be changed according to exemplary embodiments.

Figure 6:
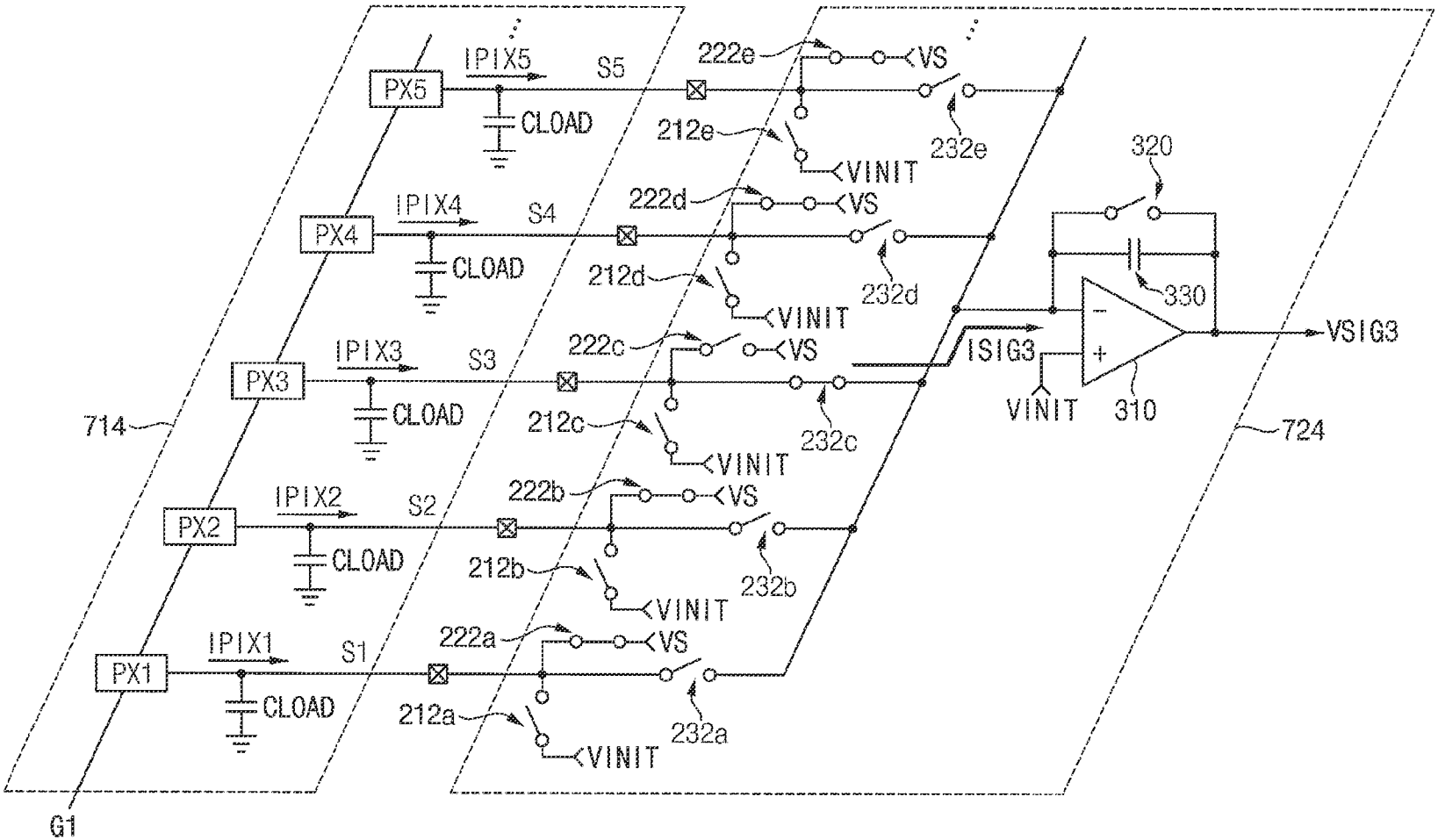
FIG. 6 is a circuit diagram illustrating another example of a sensing circuit of FIG. 1.

FIG. 6 is a circuit diagram illustrating another example of a sensing circuit of FIG. 1. The descriptions repeated with FIGS. 4 and 5D will be omitted as redundant.

Referring to FIG. 6, a sensing circuit may be included in a data driver 724, and may be connected to pixels and sensing lines included in a display panel 714.

A circuit structure of FIG. 6 may be substantially the same as the circuit structure of FIG. 4, except that the display panel 714 further includes a fifth pixel PX5 connected to a fifth scan line S5 and outputting a fifth pixel current IPIX5, and the sensing circuit further includes a fifth initialization switch 212*e*, a fifth shield switch 222*e* and a fifth signal selection switch 232*e* that are connected to the fifth scan line S5.

In FIG. 6, an example in which two sensing channels adjacent to the target sensing channel in a first direction and two sensing channels adjacent to the target sensing channel in a second direction are selected or set as the shield sensing channels is illustrated.

In other words, the plurality of sensing channels SCH may include a first sensing channel to a Y-th sensing channel, where Y is a natural number greater than or equal to five. When a J-th sensing channel is selected or set as the target sensing channel from among the first to Y-th sensing channels, where J is a natural number greater than or equal to three and less than or equal to (Y−2), two (e.g., a (J−2)-th sensing channel and a (J−1)-th sensing channel) of the first sensing channel to a (J−1)-th sensing channel included in the first to Y-th sensing channels and two (e.g., a (J+1)-th sensing channel and a (J+2)-th sensing channel) of a (J+1)-th sensing channel to the Y-th sensing channel included in the first to Y-th sensing channels may be selected or set as the at least one shield sensing channel.

For example, as illustrated in FIG. 6, the third signal selection switch 232*c* may be turned on by activating a third sensing control signal applied to the third signal selection switch 232*c*, and the third sensing line S3 may be selected or set as the target sensing channel. In addition, the first, second, fourth and fifth shield switches 222*a*, 222*b*, 222*d* and 222*e* may be turned on by activating first, second, fourth and fifth shield control signals applied to the first, second, fourth and fifth shield switches 222*a*, 222*b*, 222*d* and 222*e*, and the first, second, fourth and fifth sensing lines S1, S2, S4 and S5 may be selected or set as the shield sensing channels.

Although not illustrated in detail, when the first sensing line S1 is selected or set as the target sensing channel in the example of FIG. 6, the second and third sensing lines S2 and S3 may be selected or set as the shield sensing channels. When the second sensing line S2 is selected or set as the target sensing channel in the example of FIG. 6, the first, third and fourth sensing lines S1, S3 and S4 may be selected or set as the shield sensing channels.

Although FIGS. 4 and 6 illustrates examples in which one or two sensing channels adjacent to the target sensing channel in a first direction and one or two sensing channels adjacent to the target sensing channel in a second direction are selected or set as the shield sensing channels, exemplary embodiments are not limited thereto. For example, three or more sensing channels adjacent to the target sensing channel in a first direction and three or more sensing channels adjacent to the target sensing channel in a second direction may be selected or set as the shield sensing channels. Alternatively, all remaining sensing channels other than the target sensing channel may be selected or set as the shield sensing channels.

Figure 7:
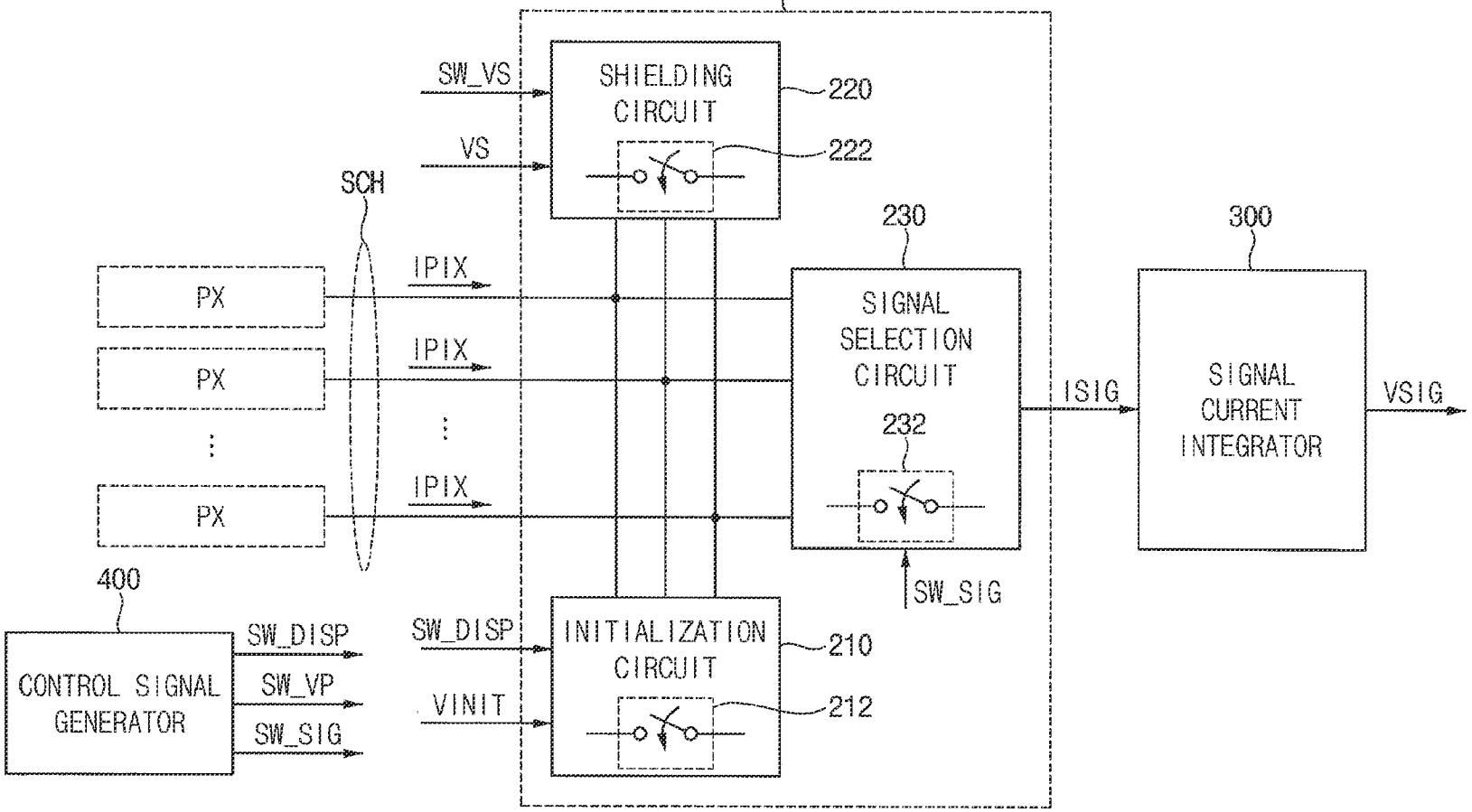
FIG. 7 is a block diagram illustrating a sensing circuit according to exemplary embodiments.

FIG. 7 is a block diagram illustrating a sensing circuit according to exemplary embodiments. The descriptions repeated with FIG. 1 will be omitted as dedundant.

Referring to FIG. 7, a sensing circuit 102 includes a switch circuit 200 and a signal current integrator 300. The sensing circuit 102 may further include a control signal generator 400.

The sensing circuit 102 of FIG. 7 may be substantially the same as the sensing circuit 100 of FIG. 1, except that the sensing circuit 102 further includes the control signal generator 400.

The control signal generator 400 may generate the initialization control signal SW_DISP, the plurality of shield control signals SW_VS and the plurality of sensing control signals SW_SIG. For example, operational timings of the initialization control signal SW_DISP, the plurality of shield control signals SW_VS and the plurality of sensing control signals SW_SIG may be implemented as described with reference to FIG. 5E to drive the sensing circuit of FIG. 4, or may be implemented to drive the sensing circuit of FIG. 6.

Figure 8A:
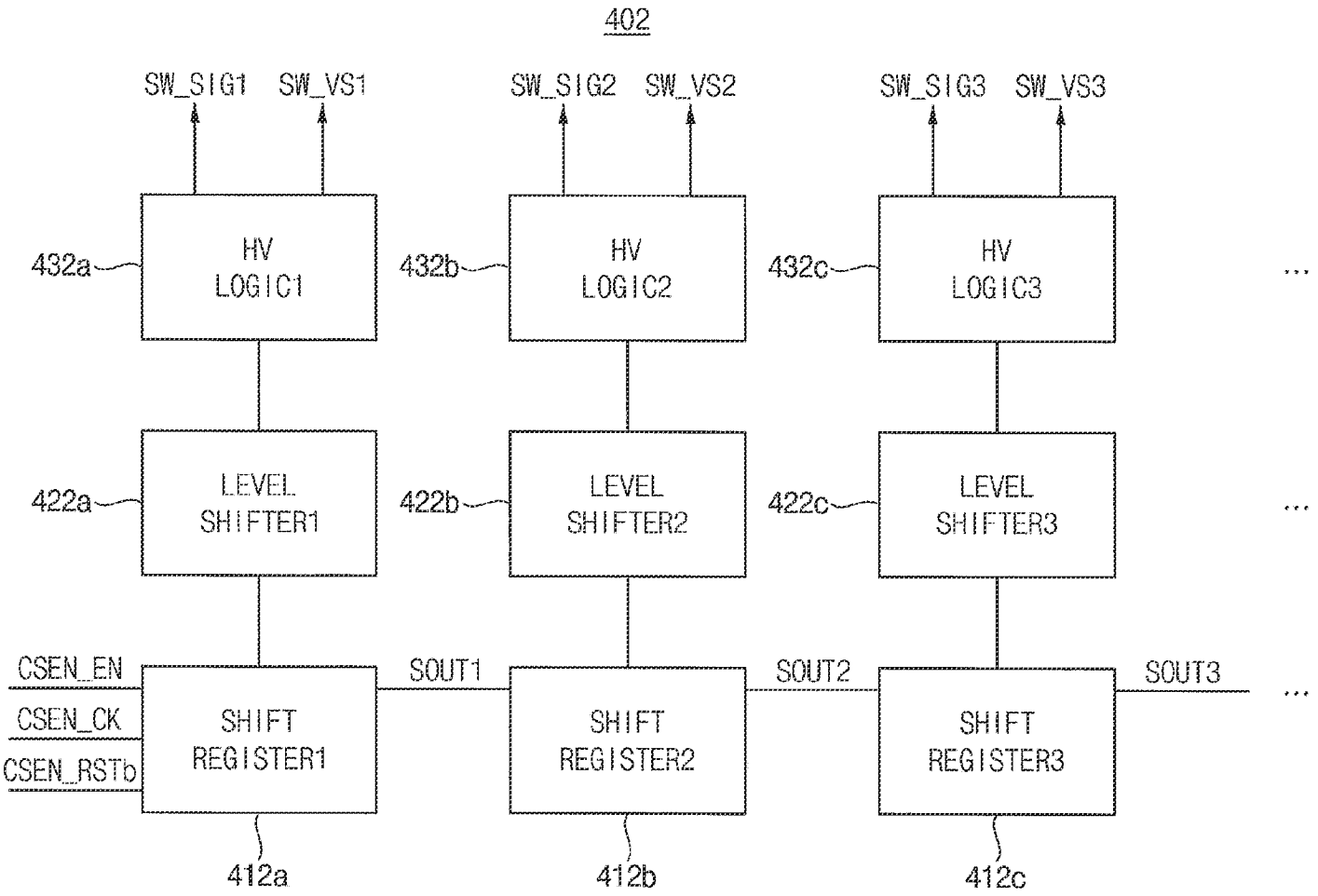
FIG. 8A is a block diagram illustrating an example of a control signal generator included in a sensing circuit of FIG. 7.
Figure 8B:
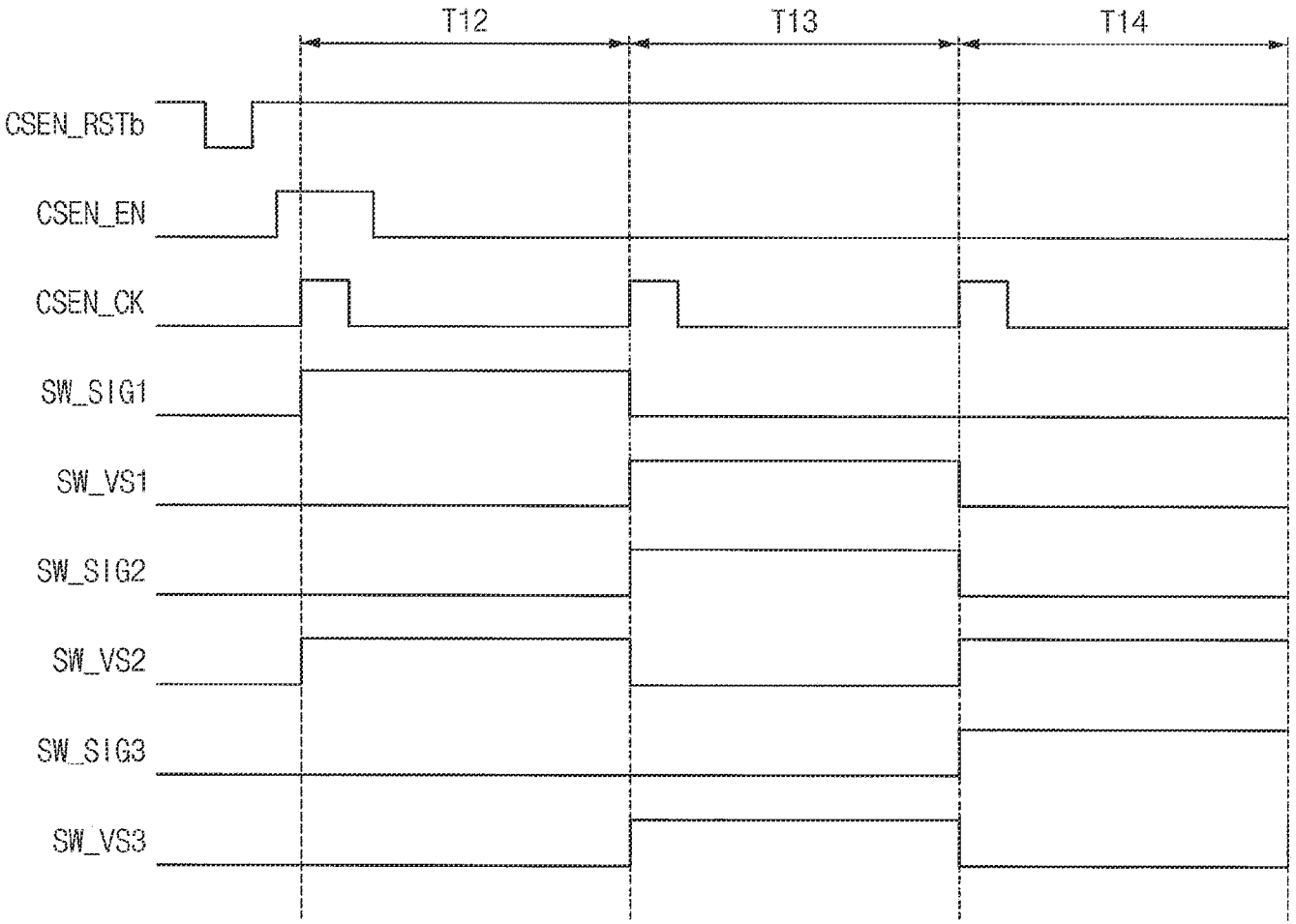
FIG. 8B is a diagram for describing an operation of a control signal generator of FIG. 8A.

FIG. 8A is a block diagram illustrating an example of a control signal generator included in a sensing circuit of FIG. 7. FIG. 8B is a diagram for describing an operation of a control signal generator of FIG. 8A.

Referring to FIGS. 8A and 8B, a control signal generator 402 may include a plurality of shift registers 412*a*, 412*b* and 412*c*, a plurality of level shifters 422*a*, 422*b* and 422*c*, and a plurality of high voltage (HV) logics 432*a*, 432*b* and 432*c*.

The control signal generator 402 of FIG. 8A may be implemented to drive the sensing circuit of FIG. 4. For convenience of illustration, only three shift registers, three level shifters and three high voltage logics are illustrated.

The plurality of shift registers 412*a*, 412*b* and 412*c* may be connected in series (or in a cascade manner), and may operate based on a sensing reset signal CSEN_RSTb, a sensing enable signal CSEN_EN and a sensing clock signal CSEN_CK. For example, the plurality of shift registers 412*a*, 412*b* and 412*c* may include elements for a low voltage (LV).

The plurality of level shifters 422*a*, 422*b* and 422*c* may perform a level change on outputs (e.g., signals corresponding to SOUT1, SOUT2 and SOUT3) of the plurality of shift registers 412*a*, 412*b* and 412*c*. For example, the outputs of the plurality of shift registers 412*a*, 412*b* and 412*c*, which are low voltage signals, may be level-shifted to high voltage signals by the plurality of level shifters 422*a*, 422*b* and 422*c*.

The plurality of high voltage logics 432*a*, 432*b* and 432*c* may generate the plurality of sensing control signals SW_SIG1, SW_SIG2 and SW_SIG3 and the plurality of shield control signals SW_VS1, SW_VS2 and SW_VS3 based on outputs of the plurality of level shifters 422*a*, 422*b* and 422*c*. For example, the plurality of high voltage logics 432*a*, 432*b* and 432*c* may include elements for a high voltage.

As illustrated in FIG. 8B, the sensing reset signal CSEN_RSTb may be activated first to a low level to reset the shift registers, and then the sensing enable signal CSEN_EN may be activated to a high level to start the sensing operation. When the sensing clock signal CSEN_CK is activated to a high level, each of the time intervals T12, T13 and T14 may start and the shift registers operate sequentially. Operations during the time intervals T12, T13 and T14 in FIG. 8B may be substantially the same as the operations during the time intervals T12, T13 and T14 in FIG. 5E, respectively.

Figure 9:
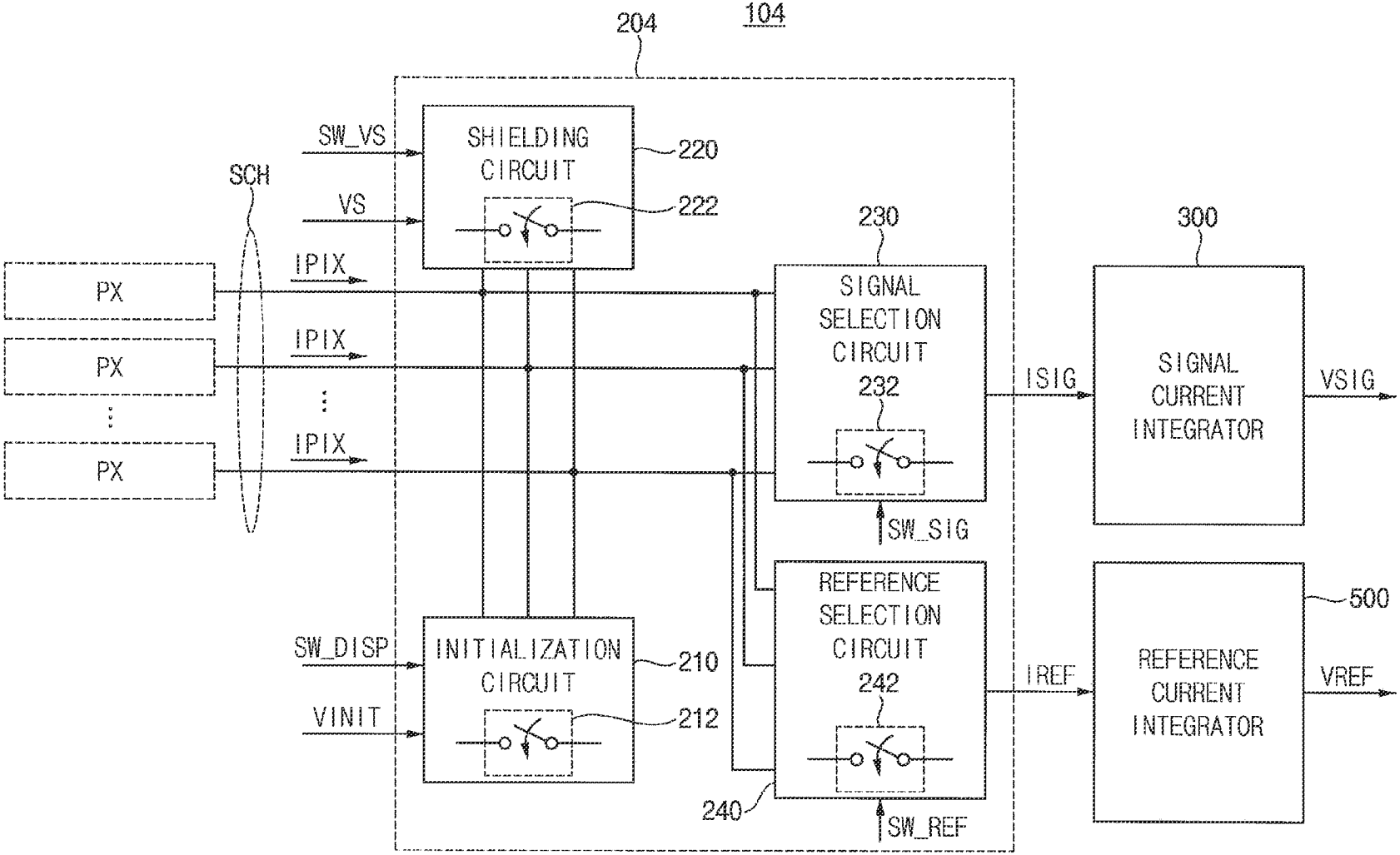
FIG. 9 is a block diagram illustrating a sensing circuit according to exemplary embodiments.

FIG. 9 is a block diagram illustrating a sensing circuit according to exemplary embodiments. The descriptions repeated with FIG. 1 will be omitted as redundant.

Referring to FIG. 9, a sensing circuit 104 includes a switch circuit 204 and a signal current integrator 300. The sensing circuit 104 may further include a reference current integrator 500.

The sensing circuit 104 of FIG. 9 may be substantially the same as the sensing circuit 100 of FIG. 1, except that the sensing circuit 104 is implemented with a differential sensing scheme, the switch circuit 204 further includes a reference selection circuit 230 and the sensing circuit 104 further includes the reference current integrator 500.

The reference selection circuit 242 may include a plurality of reference selection switches 242. The plurality of reference selection switches 242 may sequentially output the plurality of pixel currents IPIX received from the plurality of sensing channels SCH as a plurality of reference currents IREF based on a plurality of reference sensing control signals SW_REF. For example, the plurality of reference selection switches 242 may be sequentially turned on based on the plurality of reference sensing control signals SW_REF, and only one reference selection switch may be turned on at a specific time point. The plurality of reference currents IREF may be sequentially provided to the reference current integrator 500. Two adjacent sensing lines may operate as a pair of differential sensing lines. When one sensing line among a pair of differential sensing lines is selected or set as the target sensing channel, another sensing line among a pair of differential sensing lines may be selected or set as a reference sensing channel corresponding to the target sensing channel.

The reference current integrator 500 may sequentially convert the plurality of reference currents IREF into a plurality of reference voltages VREF, and may sequentially generate and output the plurality of reference voltages VREF. The one reference current integrator 500 may be shared by the plurality of sensing channels SCH. The currents ISIG and IREF and/or the voltages VSIG and VREF may be a pair of differential signals.

In some exemplary embodiments, configurations of the reference selection circuit 242 and the reference current integrator 500 may be substantially the same as those of the signal selection circuit 232 and the signal current integrator 300, respectively.

Figure 10:
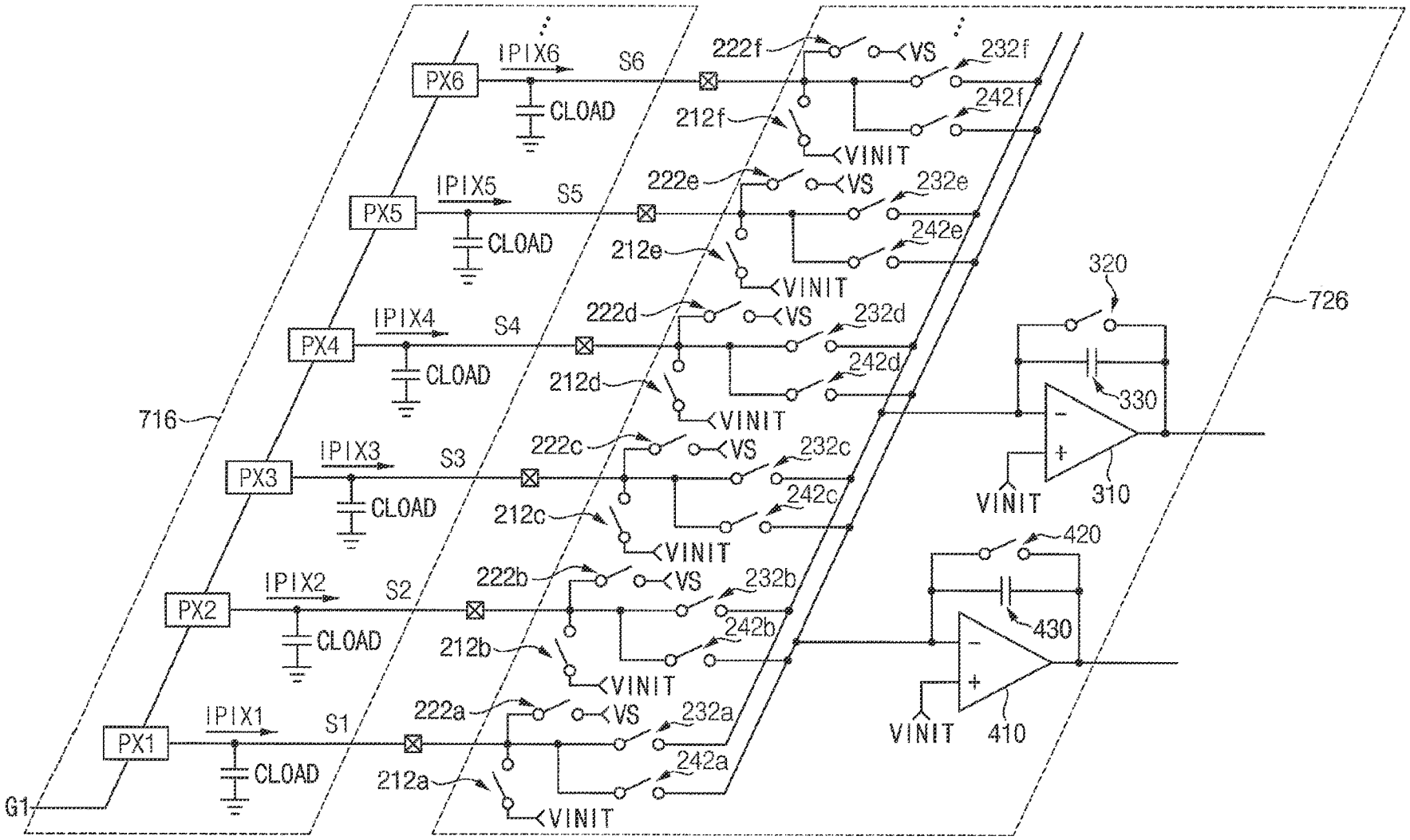
FIG. 10 is a circuit diagram illustrating an example of a sensing circuit of FIG. 9.

FIG. 10 is a circuit diagram illustrating an example of a sensing circuit of FIG. 9. The descriptions repeated with FIG. 4 will be omitted as redundant.

Referring to FIG. 10, a sensing circuit may be included in a data driver 726, and may be connected to pixels and sensing lines included in a display panel 716. For convenience of illustration, only a portion in which the sensing circuit is connected to six pixels and six sensing lines is illustrated.

First, second, third, fourth, fifth and sixth pixels PX1, PX2, PX3, PX4, PX5 and PX6 may be commonly connected to a first scan line G1, and may be connected to first, second, third, fourth, fifth and sixth sensing lines S1, S2, S3, S4, S5 and S6, respectively. The first and second sensing lines S1 and S2 may operate as a pair of differential sensing lines, the third and fourth sensing lines S3 and S4 may operate as a pair of differential sensing lines, and the fifth and sixth sensing lines S5 and S6 may operate as a pair of differential sensing lines.

The sensing circuit may include first, second, third, fourth, fifth and sixth initialization switches 212*a*, 212*b*, 212*c*, 212*d*, 212*e* and 212*f*, first, second, third, fourth, fifth and sixth shield switches 222*a*, 222*b*, 222*c*, 222*d*, 222*e* and 222*f*, first, second, third, fourth, fifth and sixth signal selection switches 232*a*, 232*b*, 232*c*, 232*d*, 232*e* and 232*f*, first, second, third, fourth, fifth and sixth reference selection switches 242*a*, 242*b*, 242*c*, 242*d*, 242*e* and 242*f*, operational amplifiers 310 and 410, reset switches 320 and 420, and feedback capacitors 330 and 430.

Configurations of the first to fourth initialization switches 212*a* to 212*d*, the first to fourth shield switches 222*a* to 222*d*, the first to fourth signal selection switches 232*a* to 232*d*, the operational amplifier 310, the reset switch 320, and the feedback capacitor 330 may be substantially the same as those described with reference to FIG. 4.

The fifth initialization switch 212*e* may be connected between the fifth sensing line S5 and the initialization voltage VINIT. The sixth initialization switch 212*f* may be connected between the sixth sensing line S6 and the initialization voltage VINIT. The fifth shield switch 222*e* may be connected between the fifth sensing line S5 and the shield voltage VS. The sixth shield switch 222*f* may be connected between the sixth sensing line S6 and the shield voltage VS. The fifth signal selection switch 232*e* may be connected between the fifth sensing line S5 and the first input terminal of the operational amplifier 310. The sixth signal selection switch 232*f* may be connected between the sixth sensing line S6 and the first input terminal of the operational amplifier 310.

The first reference selection switch 242*a* may be connected between the first sensing line S1 and a first input terminal (e.g., a negative (−) input terminal) of the operational amplifier 410. The second reference selection switch 242*b* may be connected between the second sensing line S2 and the first input terminal of the operational amplifier 410. The third reference selection switch 242*c* may be connected between the third sensing line S3 and the first input terminal of the operational amplifier 410. The fourth reference selection switch 242*d* may be connected between the fourth sensing line S4 and the first input terminal of the operational amplifier 410. The fifth reference selection switch 242*e* may be connected between the fifth sensing line S5 and the first input terminal of the operational amplifier 410. The sixth reference selection switch 242*f* may be connected between the sixth sensing line S6 and the first input terminal of the operational amplifier 410.

The operational amplifier 410 may include the first input terminal connected to the first to sixth reference selection switches 242*a* to 242*f* to sequentially receive the plurality of reference currents IREF, a second input terminal (e.g., a positive (+) input terminal) receiving the initialization voltage VINIT, and an output terminal sequentially outputting the plurality of reference voltages VREF. The reset switch 420 may be connected between the first input terminal and the output terminal of the operational amplifier 410. The feedback capacitor 430 may be connected in parallel with the reset switch 420 between the first input terminal and the output terminal of the operational amplifier 410. The operational amplifier 410, the reset switch 420 and the feedback capacitor 430 may form the reference current integrator 500 in FIG. 9.

FIGS. 11A, 11B, 11C, 11D, 11E and 11F are diagrams for describing an operation of a sensing circuit of FIG. 10. The descriptions repeated with FIGS. 5A, 5B, 5C, 5D and 5E will be omitted as redundant.

Figure 11A:
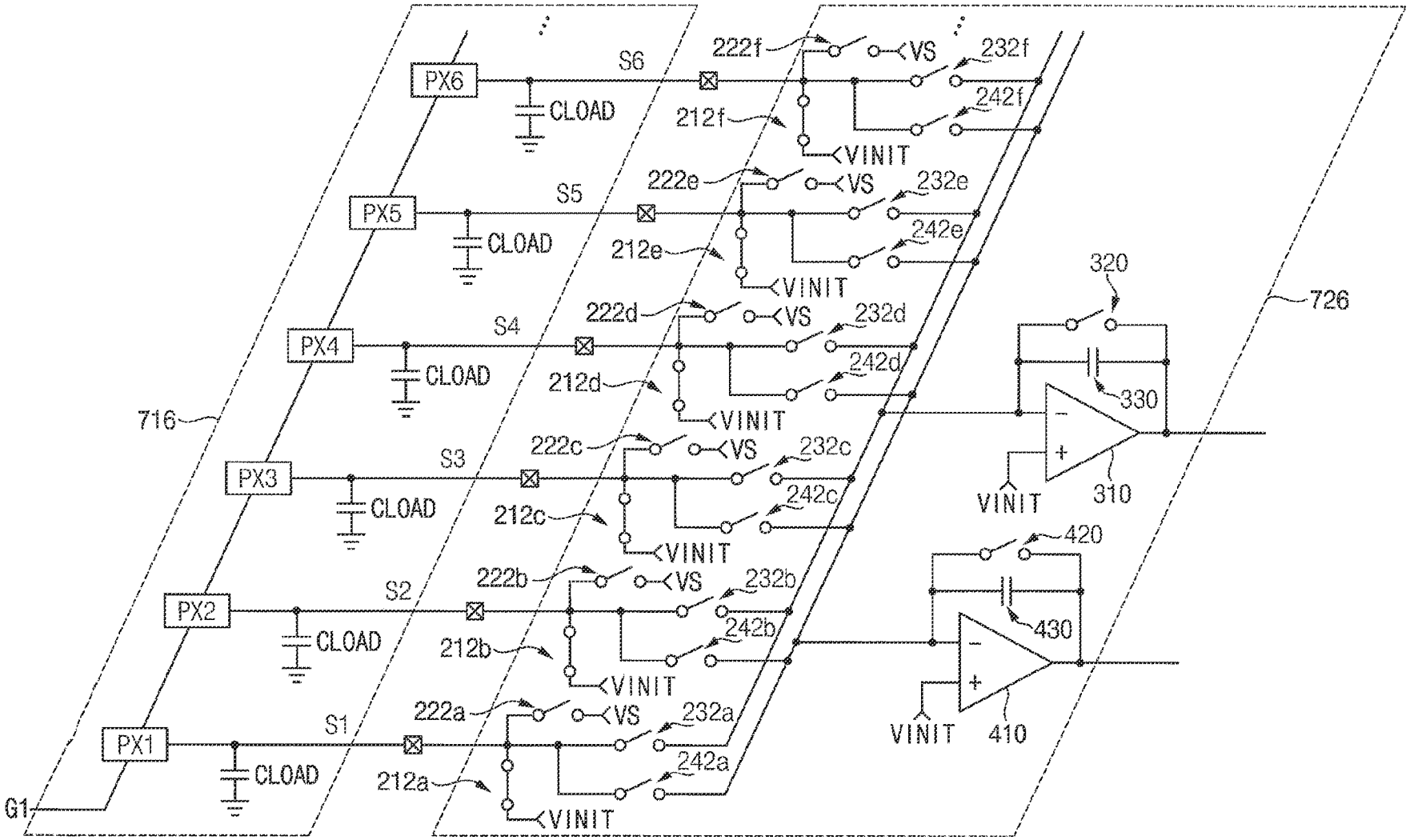
FIGS. 11A, 11B, 11C, 11D, 11E and 11F are diagrams for describing an operation of a sensing circuit of FIG. 10.
Figure 11B:
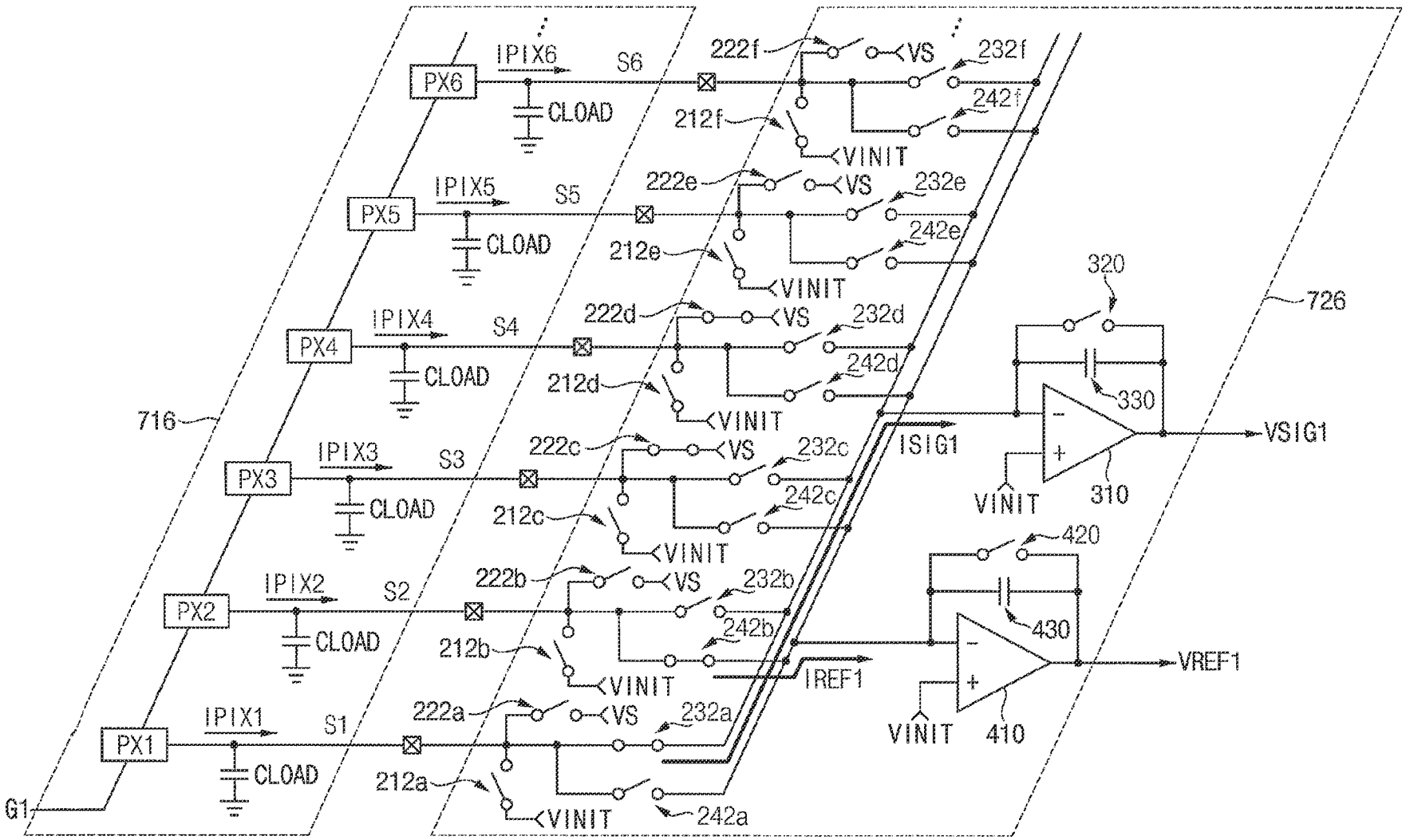
Figure 11C:
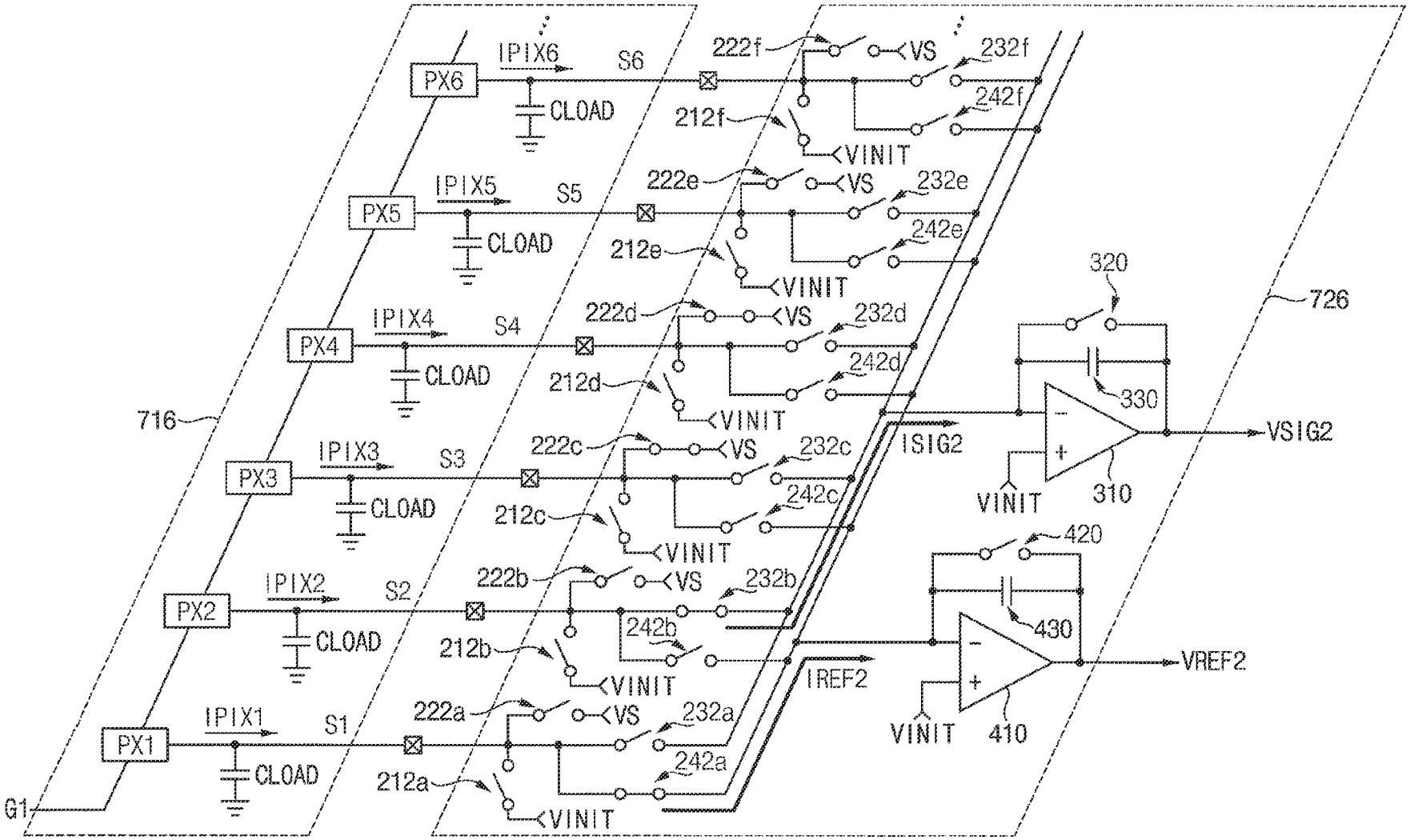
Figure 11D:
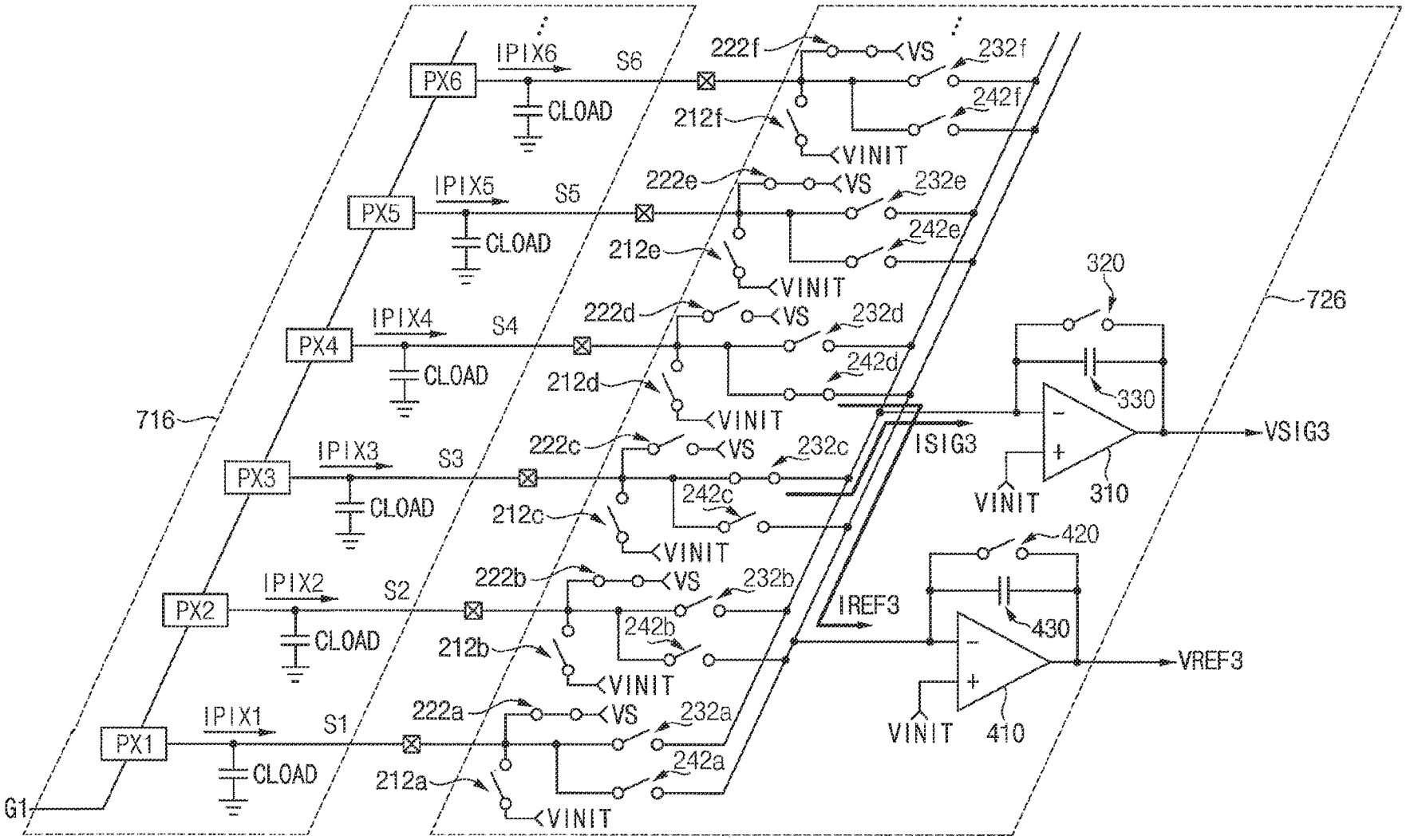
Figure 11E:
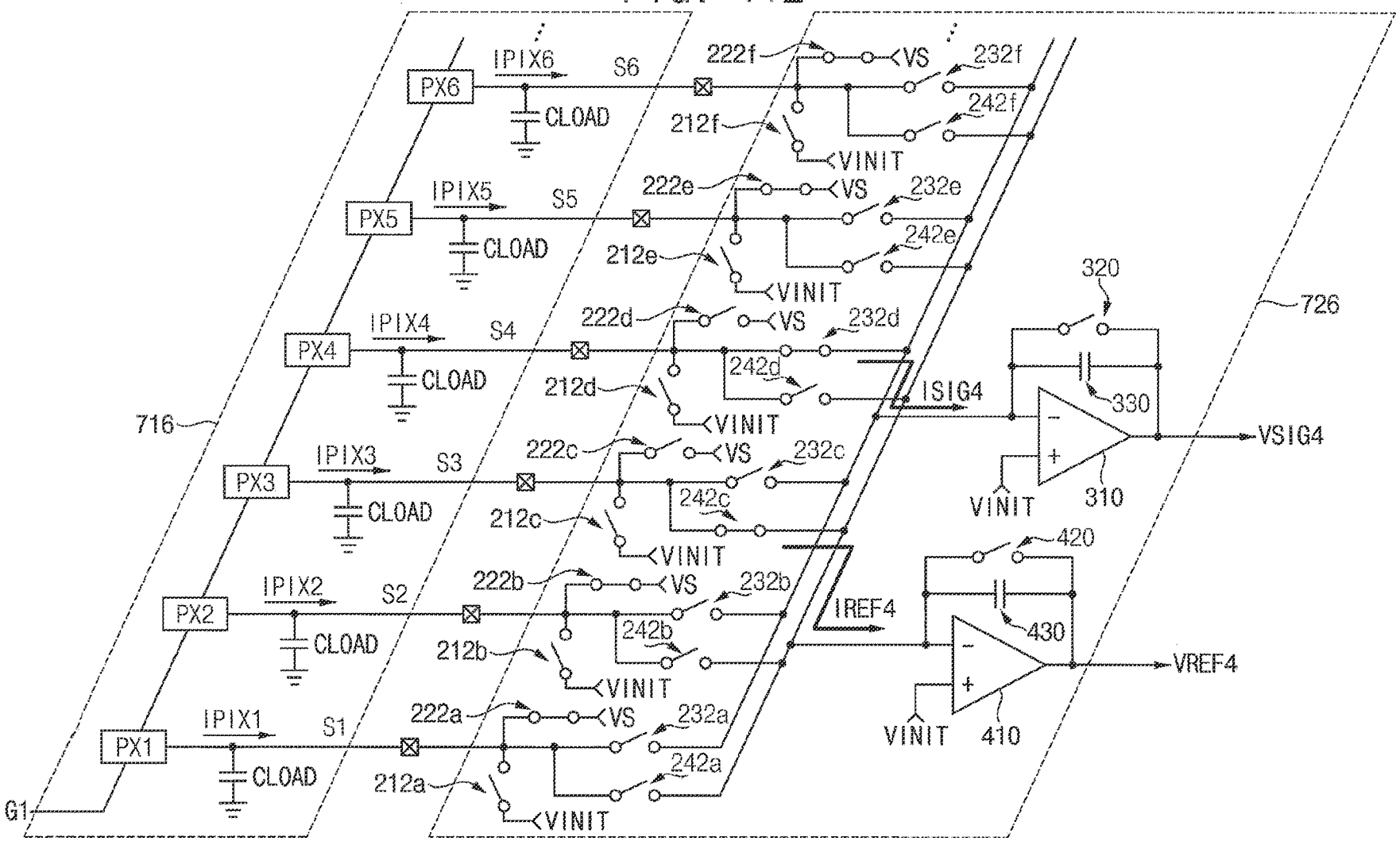
Figure 11F:
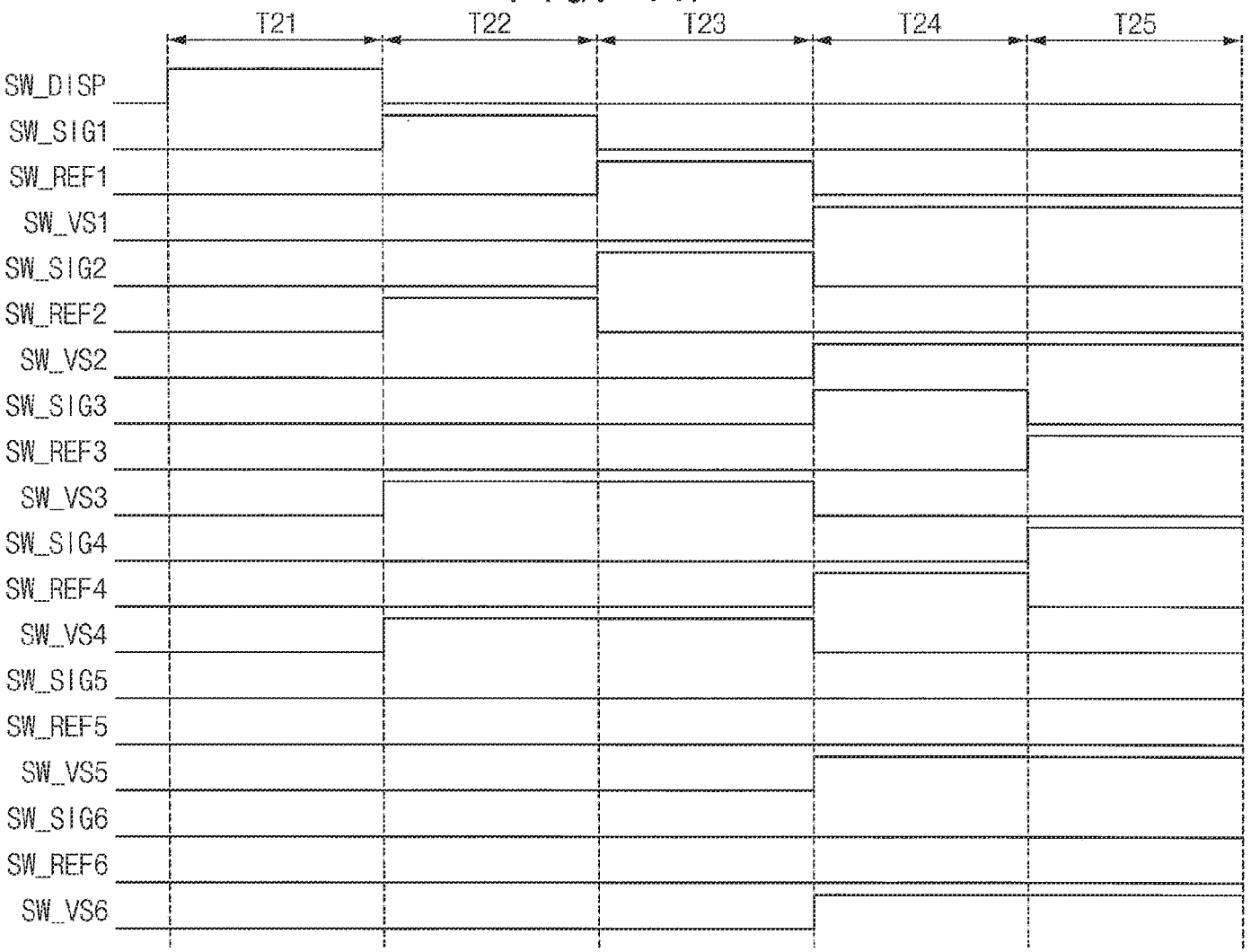

In FIG. 11F, "SW_DISP" represents the initialization control signal applied to the first to sixth initialization switches 212*a* to 212*f*, "SW_VS1", "SW_VS2", "SW_VS3", "SW_VS4", "SW_VS5" and "SW_VS6" represent first, second, third, fourth, fifth and sixth shield control signals applied to the first to sixth shield switches 222*a* to 222*f*, respectively, "SW_SIG1", "SW_SIG2", "SW_SIG3", "SW_SIG4", "SW_SIG5" and "SW_SIG6" represent first, second, third, fourth, fifth and sixth sensing control signals applied to the first to sixth signal selection switches 232*a* to 232*f*, respectively, and "SW_REF1", "SW_REF2", "SW_REF3", "SW_REF4", "SW_REF5" and "SW_REF6" represent first, second, third, fourth, fifth and sixth reference sensing control signals applied to the first to sixth reference selection switches 242*a* to 242*f*, respectively.

Referring to FIGS. 11A, 11B, 11C, 11D, 11E and 11F, an example in which two sensing channels (e.g., a pair of differential sensing channels) adjacent to a pair of target differential sensing channels including the target sensing channel in a first direction and two sensing channels adjacent to a pair of target differential sensing channels in a second direction are selected or set as the shield sensing channels is illustrated.

In other words, the plurality of sensing channels SCH may include a first sensing channel to a Z-th sensing channel, where Z is a natural number that is an even number greater than or equal to six. When a P-th sensing channel is selected or set as the target sensing channel from among the first to Z-th sensing channels, where P is a natural number that is an odd number greater than or equal to three and less than or equal to (Z−3), a (P+1)-th sensing channel may be selected or set as the reference sensing channel from among the first to Z-th sensing channels, and a (P−2)-th sensing channel, a (P−1)-th sensing channel, a (P+2)-th sensing channel and a (P+3)-th sensing channel may be selected or set as the at least one shield sensing channel from among the first to Z-th sensing channels.

In addition, the plurality of signal selection switches 232 may include a P-th signal selection switch connected to the P-th sensing channel, the plurality of reference selection switches 242 may include a (P+1)-th reference selection switch connected to the (P+1)th sensing channel, and the plurality of shield switches may include a (P−2)-th shield switch connected to the (P−2)-th sensing channel, a (P−1)-th shield switch connected to the (P−1)-th sensing channel, a (P+2)-th shield switch connected to the (P+2)-th sensing channel and a (P+3)-th shield switch connected to the (P+3)-th sensing channel A P-th sensing current received from the P-th sensing channel among the plurality of sensing currents ISIG may be provided to the signal current integrator 300 by turning on the P-th signal selection switch. A P-th reference current received from the (P+1)-th sensing channel from the plurality of reference currents IREF may be provided to the reference current integrator 500 by turning on the (P+1)-th reference selection switch. While both the P-th signal selection switch and the (P+1)-th reference selection switch are turned on, the shield voltage VS may be applied to the (P−2)-th sensing channel, the (P−1)-th sensing channel, the (P+2)-th sensing channel and the (P+3)-th sensing channel by turning on all the (P−2)-th shield switch, the (P−1)-th shield switch, the (P+2)-th shield switch and the (P+3)-th shield switch.

Further, a P-th sensing control signal from the plurality of sensing control signals SW_SIG may be activated to turn on the P-th signal selection switch. A (P+1)-th reference sensing control signal from the plurality of reference sensing control signals SW_REF may be activated to turn on the (P+1)-th reference selection switch. While both the P-th sensing control signal and the (P+1)-th reference sensing control signal are activated, all a (P−2)-th shield control signal, a (P−1)-th shield control signal, a (P+2)-th shield control signal and a (P+3)-th shield control signal from the plurality of shield control signals SW_VS may be activated to turn on all the (P−2)-th shield switch, the (P−1)-th shield switch, the (P+2)-th shield switch and the (P+3)-th shield switch.

Additionally, after a P-th sensing operation is performed by selecting the P-th sensing channel as the target sensing channel and by selecting the (P+1)-th sensing channel as the reference sensing channel, a (P+1)-th sensing operation may be performed by selecting the (P+1)-th sensing channel as the target sensing channel and by selecting the P-th sensing channel as the reference sensing channel. While the (P+1)-th sensing operation is performed, the (P−2)-th sensing channel, the (P−1)-th sensing channel, the (P+2)-th sensing channel and the (P+3)-th sensing channel may be maintained as the at least one shield sensing channel.

For example, as illustrated in FIGS. 11A and 11F, the first to sixth initialization switches 212*a* to 212*f* may be turned on by activating the initialization control signal SW_DISP during a first time interval T21. Thus, the first to sixth sensing lines S1 to S6 may be initialized with the initialization voltage VINIT, and first, second, third, fourth, fifth and sixth pixel currents IPIX1, IPIX2, IPIX3, IPIX4, IPIX5 and IPIX6 may be output from the first to sixth pixels PX1 to PX6, respectively.

After that, as illustrated in FIGS. 11B and 11F, during a second time interval T22 after the first time interval T21, the first signal selection switch 232*a* and the second reference selection switch 242*b* may be turned on by activating the first sensing control signal SW_SIG1 and the second reference sensing control signal SW_REF2, and thus the first sensing line S1 may be selected or set as the target sensing channel and the second sensing line S2 may be selected or set as the reference sensing channel In addition, during the second time interval T22, the third and fourth shield switches 222*c* and 222*d* may be turned on by activating the third and fourth shield control signals SW_VS3 and SW_VS4, and thus the third and fourth sensing lines S3 and S4 may be selected or set as the shield sensing channels. The first pixel current IPIX1 received through the first sensing line S1 may be provided as a first sensing current ISIG1, the second pixel current IPIX2 received through the second sensing line S2 may be provided as a first reference current IREF1, and the first sensing current ISIG1 and the first reference current IREF1 may be converted into a first sensing voltage VSIG1 and a first reference voltage VREF1, respectively, by performing a current integration.

After that, as illustrated in FIGS. 11C and 11F, during a third time interval T23 after the second time interval T22, the second signal selection switch 232*b* and the first reference selection switch 242*a* may be turned on by activating the second sensing control signal SW_SIG2 and the first reference sensing control signal SW_REF1, and thus the second sensing line S2 may be selected or set as the target sensing channel and the first sensing line S1 may be selected or set as the reference sensing channel. The activation of the third and fourth shield control signals SW_VS3 and SW_VS4 and the turn-on of the third and fourth shield switches 222*c* and 222*d* may be maintained, and the third and fourth sensing lines S3 and S4 may be maintained as the shield sensing channels. The second pixel current IPIX2 may be provided as a second sensing current ISIG2, the first pixel current IPIX1 may be provided as a second reference current IREF2, and the second sensing current ISIG2 and the second reference current IREF2 may be converted into a second sensing voltage VSIG2 and a second reference voltage VREF2, respectively, by performing the current integration.

Similarly, as illustrated in FIGS. 11D and 11F, during a fourth time interval T24 after the third time interval T23, the third signal selection switch 232*c* and the fourth reference selection switch 242*d* may be turned on by activating the third sensing control signal SW_SIG3 and the fourth reference sensing control signal SW_REF4, and thus the third sensing line S3 and the fourth sensing line S4 may be selected or set as the target sensing channel and the reference sensing channel, respectively. In addition, during the fourth time interval T24, the first, second, fifth and sixth shield switches 222*a*, 222*b*, 222*e* and 222*f* may be turned on by activating the first, second, fifth and sixth shield control signals SW_VS1, SW_VS2, SW_VS5 and SW_VS6, and thus the first, second, fifth and sixth sensing lines S1, S2, S5 and S6 may be selected or set as the shield sensing channels. The third pixel current IPIX3 may be provided as a third sensing current ISIG3, the fourth pixel current IPIX4 may be provided as a third reference current IREF3, and the third sensing current ISIG3 and the third reference current IREF3 may be converted into a third sensing voltage VSIG3 and a third reference voltage VREF3, respectively, by performing current integration.

After that, as illustrated in FIGS. 11E and 11F, during a fifth time interval T25 after the fourth time interval T24, the fourth signal selection switch 232*d* and the third reference selection switch 242*c* may be turned on by activating the fourth sensing control signal SW_SIG4 and the third reference sensing control signal SW_REF3, and thus the fourth sensing line S4 and the third sensing line S3 may be selected or set as the target sensing channel and the reference sensing channel, respectively. The first, second, fifth, and sixth sensing lines S1, S2, S5 and S6 may be maintained as the shield sensing channels. The fourth pixel current IPIX4 may be provided as a fourth sensing current ISIG4, the third pixel current IPIX3 may be provided as a fourth reference current IREF4, and the fourth sensing current ISIG4 and the fourth reference current IREF4 may be converted into a fourth sensing voltage VSIG4 and a fourth reference voltage VREF4, respectively, by performing current integration.

Figure 12:
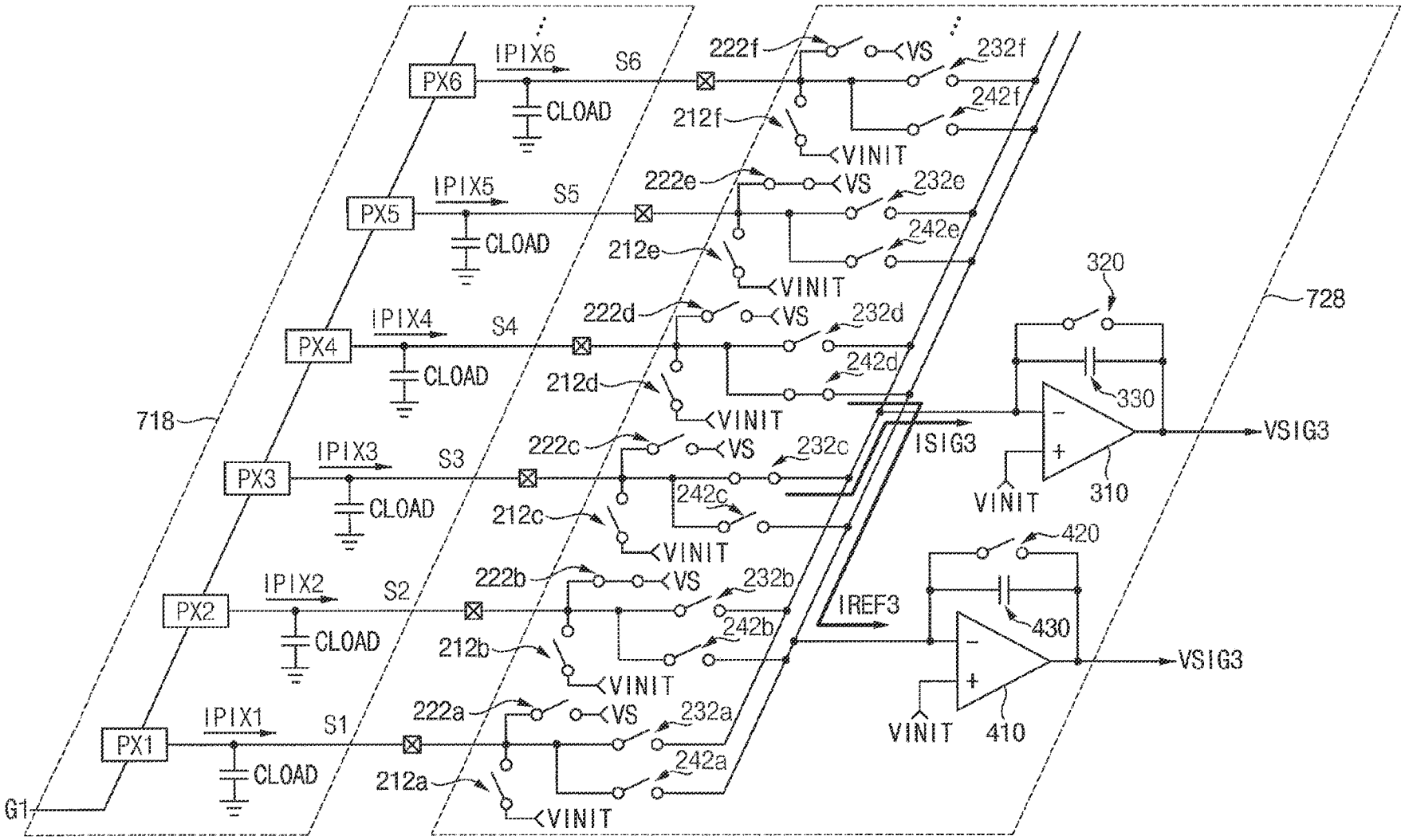
FIG. 12 is a circuit diagram illustrating another example of a sensing circuit of FIG. 9.

FIG. 12 is a circuit diagram illustrating another example of a sensing circuit of FIG. 9. The descriptions repeated with FIGS. 10 and 11D will be omitted as redundant.

Referring to FIG. 12, a sensing circuit may be included in a data driver 728, and may be connected to pixels and sensing lines included in a display panel 718. A circuit structure of FIG. 12 may be substantially the same as the circuit structure of FIG. 10.

In FIG. 12, an example in which one sensing channel adjacent to a pair of target differential sensing channels including the target sensing channel in a first direction and one sensing channel adjacent to a pair of target differential sensing channels in a second direction are selected or set as the shield sensing channels is illustrated.

In other words, the plurality of sensing channels SCH may include a first sensing channel to a Z-th sensing channel, where Z is a natural number that is an even number greater than or equal to six. When a P-th sensing channel is selected or set as the target sensing channel from among the first to Z-th sensing channels, where P is a natural number that is an odd number greater than or equal to three and less than or equal to (Z−3), a (P+1)-th sensing channel may be selected or set as the reference sensing channel from among the first to Z-th sensing channels, and one (e.g., a (P−1)-th sensing channel) of the first sensing channel to a (P−1)-th sensing channel included in the first to Z-th sensing channels and one (e.g., a (P+2)-th sensing channel) of a (P+2)-th sensing channel to the Z-th sensing channel included in the first to Z-th sensing channels may be selected or set as the at least one shield sensing channel.

For example, as illustrated in FIG. 12, the third sensing line S3 and the fourth sensing line S4 may be selected or set as the target sensing channel and the reference sensing channel, respectively. In addition, the second and fifth sensing lines S2 and S5 may be selected or set as the shield sensing channels.

The number of shield sensing channels may be changed according to exemplary embodiments.

Figure 13:
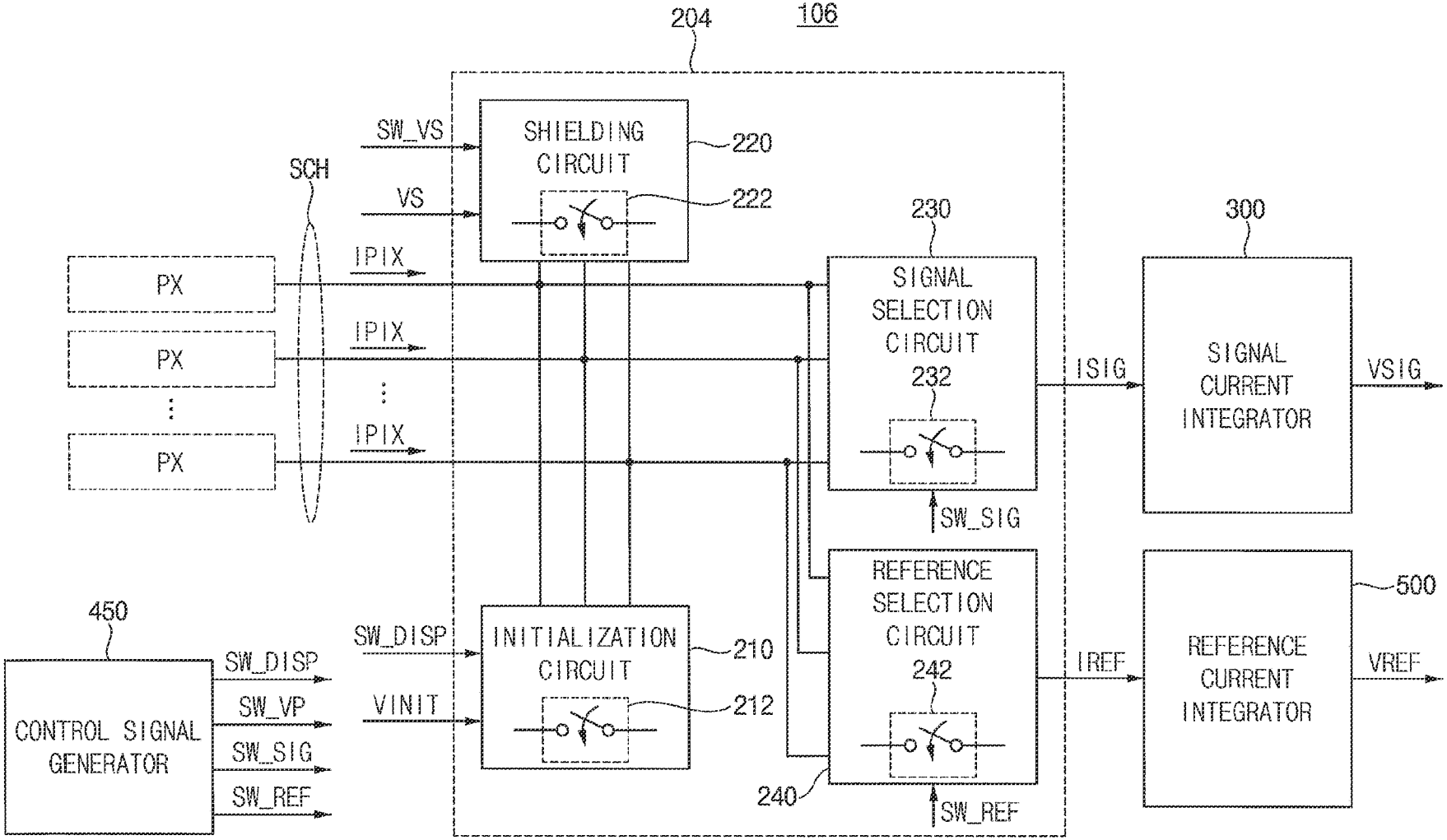
FIG. 13 is a block diagram illustrating a sensing circuit according to exemplary embodiments.

FIG. 13 is a block diagram illustrating a sensing circuit according to exemplary embodiments. The descriptions repeated with FIGS. 7 and 9 will be omitted as redundant.

Referring to FIG. 13, a sensing circuit 106 includes a switch circuit 204, a signal current integrator 300 and a reference current integrator 500. The sensing circuit 106 may further include a control signal generator 450.

The sensing circuit 106 of FIG. 13 may be substantially the same as the sensing circuit 104 of FIG. 9, except that the sensing circuit 106 further includes the control signal generator 450.

The control signal generator 450 may generate the initialization control signal SW_DISP, the plurality of shield control signals SW_VS, the plurality of sensing control signals SW_SIG and the plurality of reference sensing control signals SW_REF.

Figure 14A:
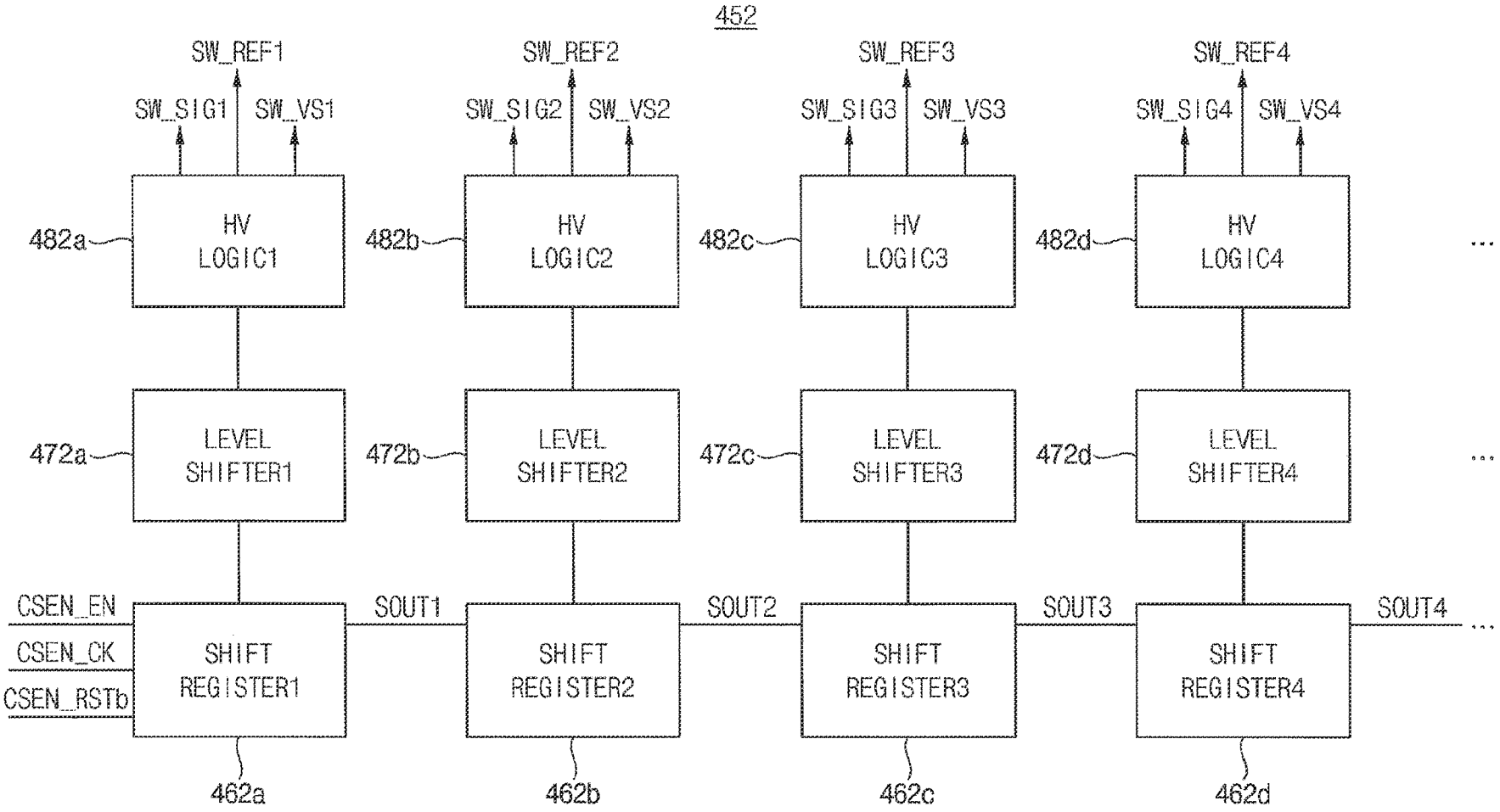
FIG. 14A is a block diagram illustrating an example of a control signal generator included in a sensing circuit of FIG. 13.
Figure 14B:
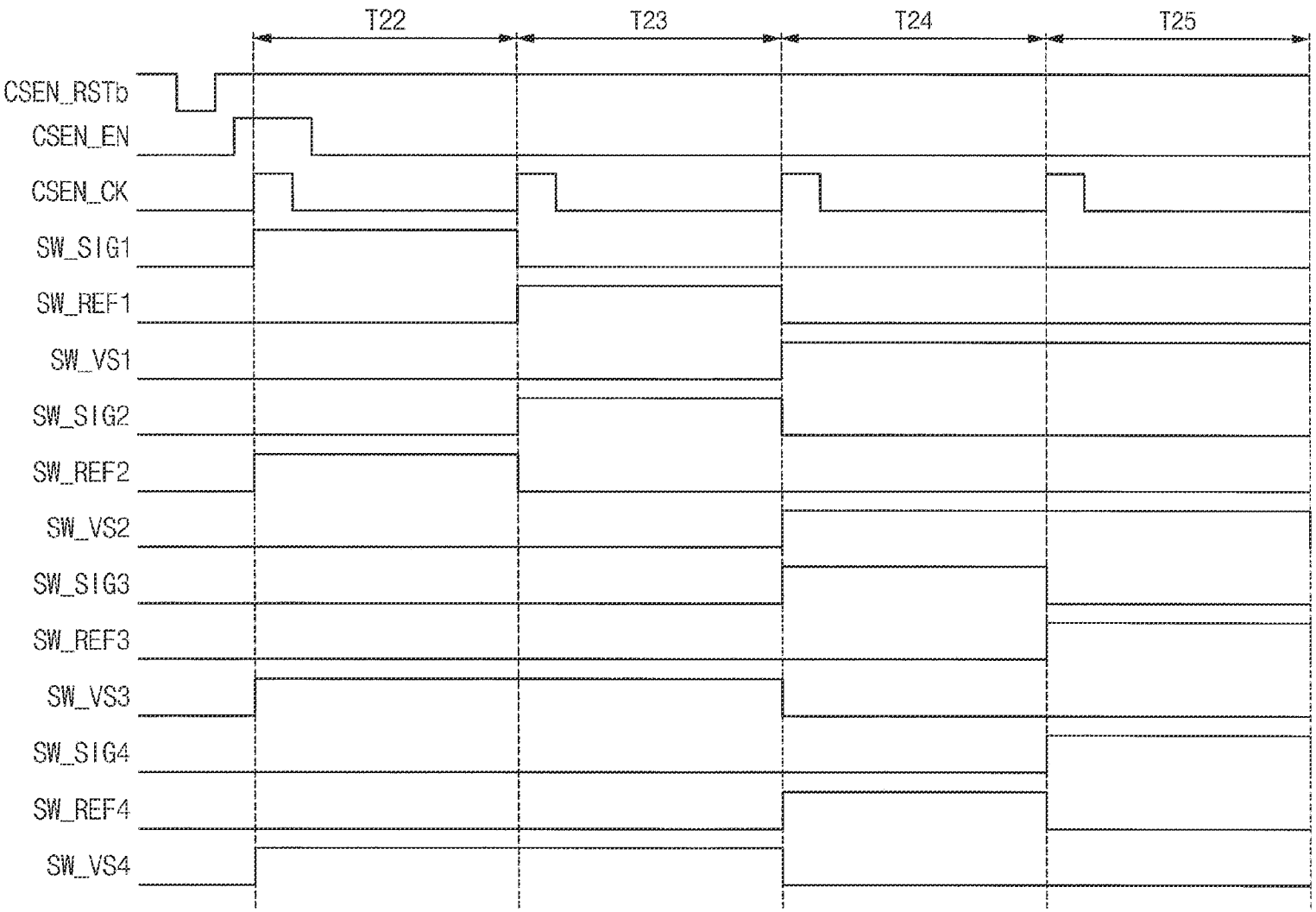
FIG. 14B is a diagram for describing an operation of a control signal generator of FIG. 14A.

FIG. 14A is a block diagram illustrating an example of a control signal generator included in a sensing circuit of FIG. 13. FIG. 14B is a diagram for describing an operation of a control signal generator of FIG. 14A. The descriptions repeated with FIGS. 8A and 8B will be omitted as redundant.

Referring to FIGS. 14A and 14B, a control signal generator 452 may include a plurality of shift registers 462*a*, 462*b*, 462*c* and 462*d*, a plurality of level shifters 472*a*, 472*b*, 472*c* and 472*d*, and a plurality of high voltage logics 482*a*, 482*b*, 482*c* and 482*d*.

The control signal generator 452 of FIG. 14A may be implemented to drive the sensing circuit of FIG. 10. For convenience of illustration, only four shift registers, four level shifters and four high voltage logics are shown.

The plurality of shift registers 462*a*, 462*b*, 462*c* and 462*d* may be connected in series (or in a cascade manner), and may operate based on a sensing reset signal CSEN_RSTb, a sensing enable signal CSEN_EN and a sensing clock signal CSEN_CK. The plurality of level shifters 472*a*, 472*b*, 472*c* and 472*d* may perform a level change on outputs (e.g., signals corresponding to SOUT1, SOUT2, SOUT3 and SOUT4) of the plurality of shift registers 462*a*, 462*b*, 462*c* and 462*d*. The plurality of high voltage logics 482*a*, 482*b*, 482*c* and 482*d* may generate the plurality of sensing control signals SW_SIG1, SW_SIG2, SW_SIG3 and SW_SIG4, the plurality of reference sensing control signals SW_REF1, SW_REF2, SW_REF3 and SW_REF4, and the plurality of shield control signals SW_VS1, SW_VS2, SW_VS3 and SW_VS4 based on outputs of the plurality of level shifters 472*a*, 472*b*, 472*c* and 472*d*.

In FIG. 14B, operations of the sensing reset signal CSEN_RSTb, the sensing enable signal CSEN_EN and the sensing clock signal CSEN_CK may be substantially the same as those described with reference to FIG. 8B, and operations during the time intervals T22, T23, T24 and T25 may be substantially the same as the operations during the time intervals T22, T23, T24 and T25 in FIG. 11F, respectively.

Figure 15:
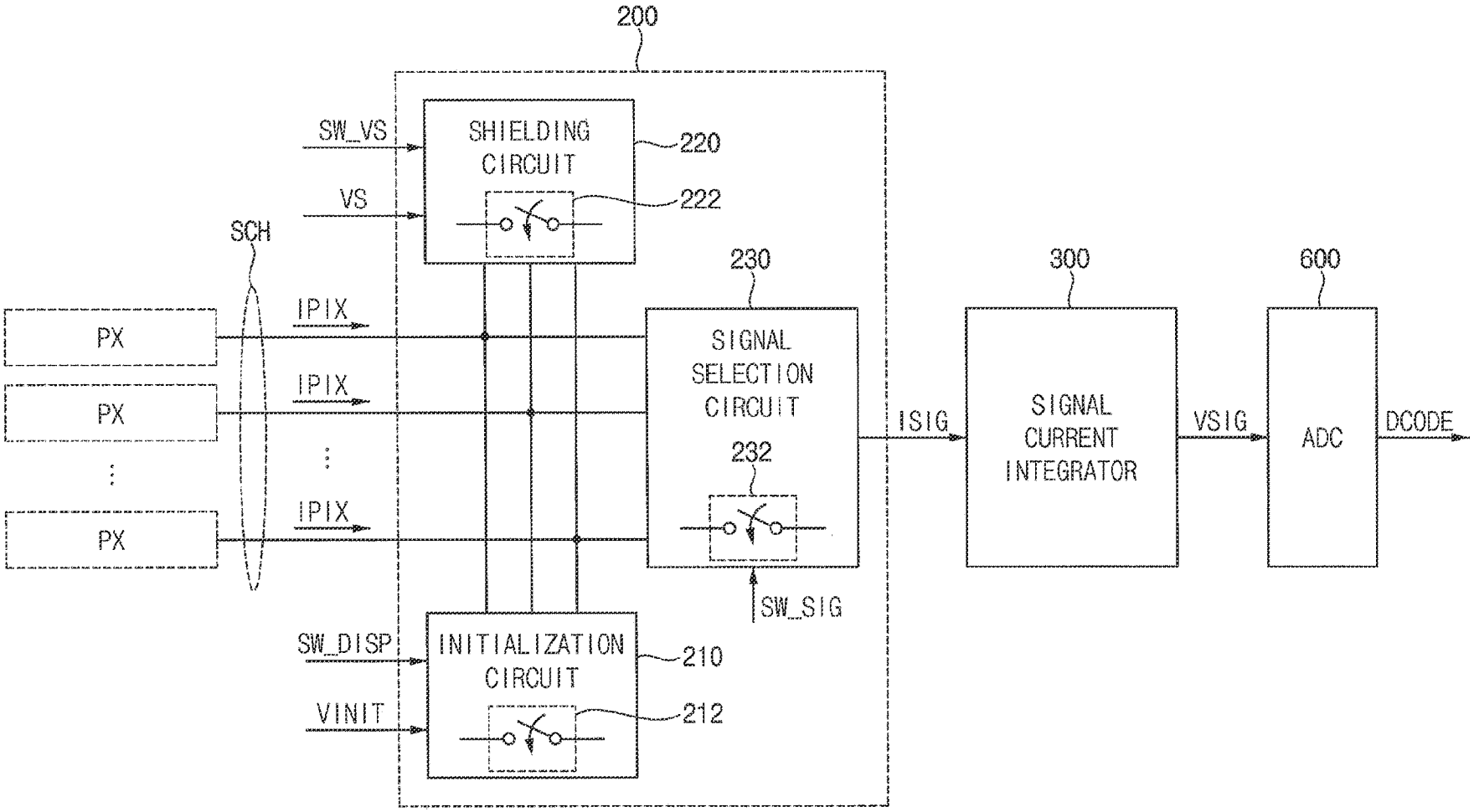
FIG. 15 is a block diagram illustrating a sensing circuit according to exemplary embodiments.

FIG. 15 is a block diagram illustrating a sensing circuit according to exemplary embodiments. The descriptions repeated with FIG. 1 will be omitted as redundant.

Referring to FIG. 15, a sensing circuit 108 includes a switch circuit 200 and a signal current integrator 300. The sensing circuit 108 may further include an analog-to-digital converter 600.

The sensing circuit 108 of FIG. 15 may be substantially the same as the sensing circuit 100 of FIG. 1, except that the sensing circuit 108 further includes the analog-to-digital converter 600.

The analog-to-digital converter 600 may convert the plurality of sensing voltages VSIG into a plurality of digital codes DCODE.

In some exemplary embodiments, the sensing circuits 102, 104 and 106 of FIGS. 7, 9 and 12 may also include an analog-to-digital converter.

Figure 16:
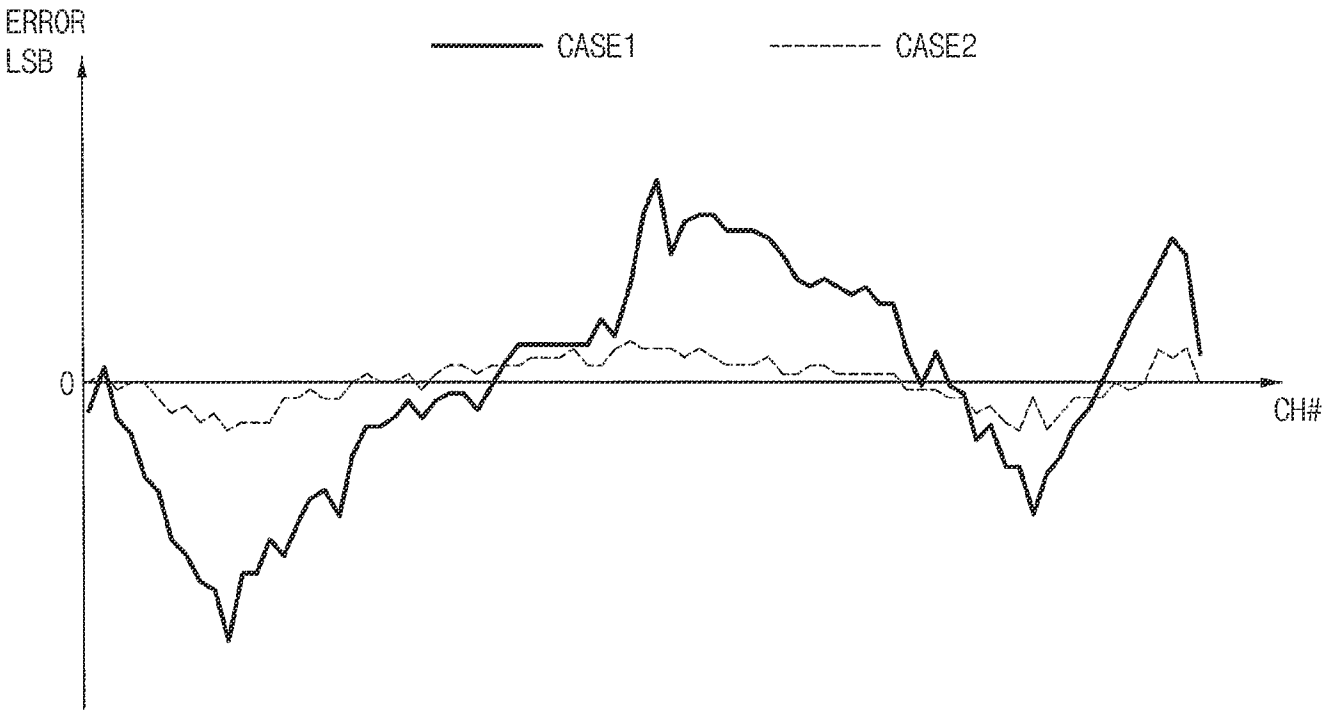
FIG. 16 is a diagram for describing performance of a sensing circuit according to exemplary embodiments.

FIG. 16 is a diagram for describing performance of a sensing circuit according to exemplary embodiments.

Referring to FIG. 16, CASE1 represents a conventional serial current sensing scheme, and CASE2 represents an example in which the active shielding scheme according to exemplary embodiments is applied or employed for the serial current sensing scheme. It can be seen that offset errors ERROR LSB of channels CH # is reduced when the active shielding scheme is applied.

Figure 17:
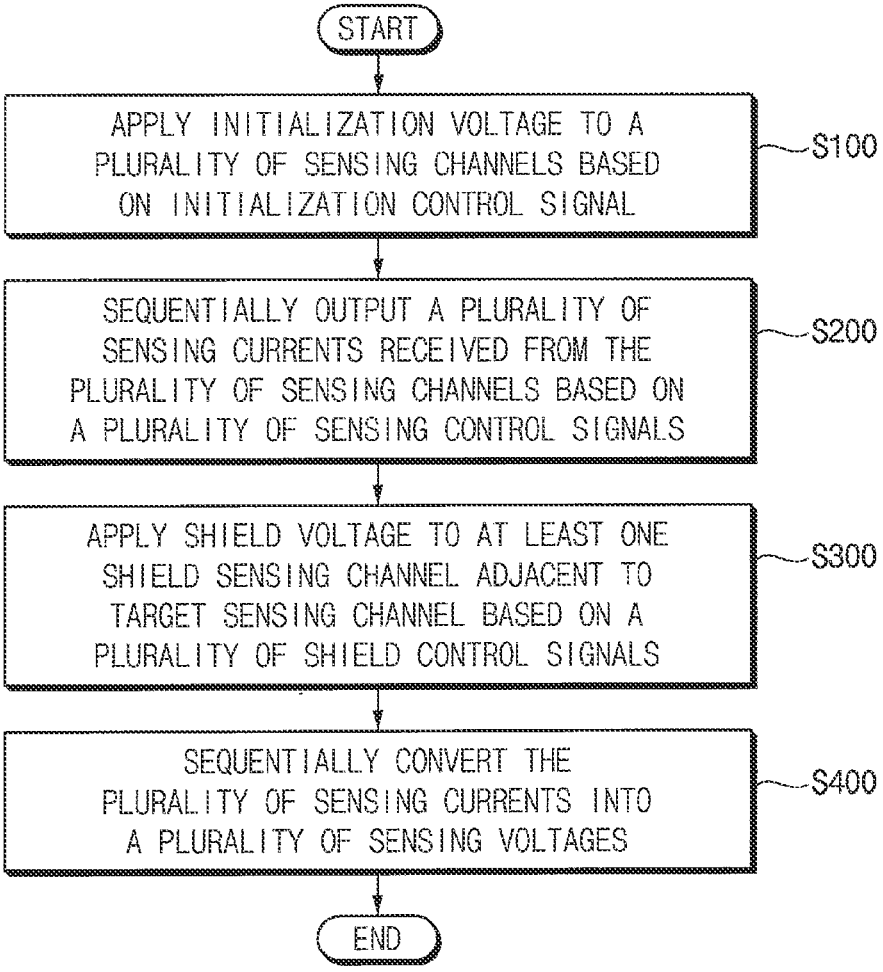
FIG. 17 is a flowchart illustrating a method of detecting characteristic of a display panel according to exemplary embodiments.

FIG. 17 is a flowchart illustrating a method of detecting characteristic of a display panel according to exemplary embodiments.

Referring to FIGS. 1 and 17, in a method of detecting characteristic of a display panel according to exemplary embodiments, the initialization voltage VINIT is applied to the plurality of sensing channels SCH based on the initialization control signal SW_DISP (step S100). The plurality of sensing currents ISIG received from the plurality of sensing channels SCH are sequentially output based on the plurality of sensing control signals SW_SIG (step S200). The shield voltage VS is applied to the at least one shield sensing channel adjacent to the target sensing channel based on the plurality of shield control signals SW_VS (step S300). The plurality of sensing currents ISIG are sequentially converted into the plurality of sensing voltages VSIG (step S400).

Steps S100, S200, S300 and S400 may be performed by the initialization circuit 210, the shielding circuit 220, the signal selection circuit 230 and the signal current integrator 300, respectively. Steps S200, S300 and S400 may be performed substantially simultaneously or may be sequentially performed for each sensing line.

Figure 18:
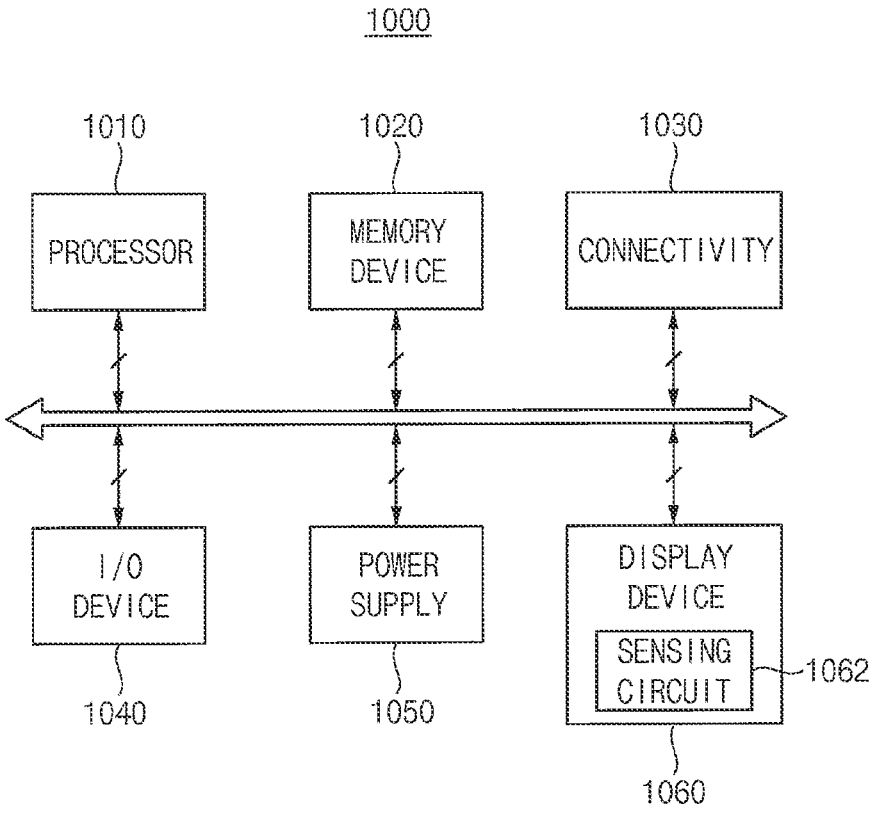
FIG. 18 is a block diagram illustrating an electronic system according to exemplary embodiments.

FIG. 18 is a block diagram illustrating an electronic system according to exemplary embodiments.

Referring to FIG. 18, an electronic system 1000 may include a processor 1010, a memory device 1020, a connector 1030, an input/output (I/O) device 1040, a power supply 1050 and a display device 1060. The electronic system 1000 may further include a plurality of ports for communicating a video card, a sound card, a memory card, a universal serial bus (USB) device, other electronic devices, etc.

The processor 1010 may control operations of the electronic system 1000. The processor 1010 may execute an operating system and at least one application to provide an internet browser, games, videos, or the like. The memory device 1020 may store data for the operations of the electronic system 1000. The connector 1030 may couple with an external device and/or system. The I/O device 1040 may include an input device such as a keyboard, a keypad, a mouse, a touchpad, a touch-screen, a remote controller, etc., and an output device such as a printer, a speaker, etc. The power supply 1050 may provide a power for operations of the electronic system 1000.

The display device 1060 may include a display panel and a display driver integrated circuit. The display device 1060 and the display driver integrated circuit may be the display device and the display driver integrated circuit according to exemplary embodiments, respectively. The display driver integrated circuit may include a sensing circuit 1062 for detecting the characteristics of the plurality of pixels, and may perform the method of detecting the characteristic of the display panel according to exemplary embodiments.

The inventive concept may be applied to various electronic devices and systems that include the display devices. For example, the inventive concept may be applied to systems such as a personal computer (PC), a server computer, a data center, a workstation, a mobile phone, a smart phone, a tablet computer, a laptop computer, a personal digital assistant (PDA), a portable multimedia player (PMP), a digital camera, a portable game console, a music player, a camcorder, a video player, a navigation device, a wearable device, an internet of things (IoT) device, an internet of everything (IoE) device, an e-book reader, a virtual reality (VR) device, an augmented reality (AR) device, a robotic device, a drone, etc.

The foregoing is illustrative of example embodiments and is not to be construed as limiting thereof. Although some exemplary embodiments have been described, those skilled in the art will readily appreciate that many modifications are possible in the exemplary embodiments without materially departing from the novel teachings and advantages of such exemplary embodiments. Accordingly, all such modifications are intended to be included within the scope of the exemplary embodiments as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A sensing circuit connected to a plurality of pixels in a display panel through a plurality of sensing channels, the sensing circuit comprising:

a plurality of initialization switches configured to apply an initialization voltage to the plurality of sensing channels based on an initialization control signal;

a plurality of shield switches configured to apply a fixed-value shield voltage different from the initialization voltage to the plurality of sensing channels based on a plurality of shield control signals;

a plurality of signal selection switches configured to sequentially output a plurality of sensing currents received from the plurality of sensing channels based on a plurality of sensing control signals; and a signal current integrator configured to sequentially convert the plurality of sensing currents into a plurality of sensing voltages, wherein concurrent with the signal current integrator converting a target sensing current, among the plurality of sensing currents, received from a target sensing channel, among the plurality of sensing channels, into a target sensing voltage among the plurality of sensing voltages, the fixed-value shield voltage is applied to at least one adjacent shield sensing channel that is adjacent to the target sensing channel.

2. The sensing circuit of claim 1, wherein:

the plurality of sensing channels include a first sensing channel to an X-th sensing channel, where X is a natural number greater than or equal to three, and when a K-th sensing channel is selected as the target sensing channel from among the first to X-th sensing channels, where K is a natural number greater than or equal to two and less than or equal to (X−1), a (K−1)-th sensing channel and a (K+1)-th sensing channel are selected as the at least adjacent one shield sensing channel from among the first to X-th sensing channels.

3. The sensing circuit of claim 2, wherein:

the plurality of signal selection switches include a K-th signal selection switch connected to the K-th sensing channel, the plurality of shield switches include a (K−1)-th shield switch connected to the (K−1)-th sensing channel and a (K+1)-th shield switch connected to the (K+1)-th sensing channel, a K-th sensing current received from the K-th sensing channel from the plurality of sensing currents is provided to the signal current integrator by turning on the K-th signal selection switch, and while the K-th signal selection switch is turned on, the fixed-value shield voltage is applied to the (K−1)-th sensing channel and the (K+1)-th sensing channel by turning on both the (K−1)-th shield switch and the (K+1)-th shield switch.

4. The sensing circuit of claim 3, wherein:

a K-th sensing control signal among the plurality of sensing control signals is activated to turn on the K-th signal selection switch, and while the K-th sensing control signal is activated, both a (K−1)-th shield control signal and a (K+1)-th shield control signal among the plurality of shield control signals are activated to turn on both the (K−1)-th shield switch and the (K+1)-th shield switch.

5. The sensing circuit of claim 1, further comprising: a control signal generator configured to generate the initialization control signal, the plurality of shield control signals and the plurality of sensing control signals.

6. The sensing circuit of claim 5, wherein the control signal generator includes:

a plurality of shift registers connected in series, and configured to operate based on a sensing reset signal, a sensing enable signal and a sensing clock signal;

a plurality of level shifters configured to perform a level change on outputs of the plurality of shift registers; and a plurality of high voltage logics configured to generate the plurality of sensing control signals and the plurality of shield control signals based on outputs of the plurality of level shifters.

7. The sensing circuit of claim 1, wherein:

the plurality of sensing channels include a first sensing channel to a Y-th sensing channel, where Y is a natural number greater than or equal to five, and when a J-th sensing channel is selected as the target sensing channel from among the first to Y-th sensing channels, where J is a natural number greater than or equal to three and less than or equal to (Y−2), at least two of the first sensing channel to a (J−1)-th sensing channel included in the first to Y-th sensing channels and at least two of a (J+1)-th sensing channel to the Y-th sensing channel included in the first to Y-th sensing channels are selected as the at least one adjacent shield sensing channel.

8. The sensing circuit of claim 1, further comprising:

a plurality of reference selection switches configured to sequentially output a plurality of reference currents received from the plurality of sensing channels based on a plurality of reference sensing control signals; and a reference current integrator configured to sequentially convert the plurality of reference currents into a plurality of reference voltages.

9. The sensing circuit of claim 8, wherein:

the plurality of sensing channels include a first sensing channel to a Z-th sensing channel, where Z is a natural number that is an even number greater than or equal to six, and when a P-th sensing channel is selected as the target sensing channel from among the first to Z-th sensing channels, where P is a natural number that is an odd number greater than or equal to three and less than or equal to (Z−3), a (P+1)-th sensing channel is selected as a reference sensing channel corresponding to the target sensing channel from among the first to Z-th sensing channels, and a (P−2)-th sensing channel, a (P−1)-th sensing channel, a (P+2)-th sensing channel and a (P+3)-th sensing channel are selected as the at least one adjacent shield sensing channel from among the first to Z-th sensing channels.

10. The sensing circuit of claim 9, wherein:

the plurality of signal selection switches include a P-th signal selection switch connected to the P-th sensing channel, the plurality of reference selection switches include a (P+1)-th reference selection switch connected to the (P+1)th sensing channel, the plurality of shield switches include a (P−2)-th shield switch connected to the (P−2)-th sensing channel, a (P−1)-th shield switch connected to the (P−1)-th sensing channel, a (P+2)-th shield switch connected to the (P+2)-th sensing channel and a (P+3)-th shield switch connected to the (P+3)-th sensing channel, a P-th sensing current received from the P-th sensing channel from the plurality of sensing currents is provided to the signal current integrator by turning on the P-th signal selection switch, a P-th reference current received from the (P+1)-th sensing channel from the plurality of reference currents is provided to the reference current integrator by turning on the (P+1)-th reference selection switch, and while both the P-th signal selection switch and the (P+1)-th reference selection switch are turned on, the fixed-value shield voltage is applied to the (P−2)-th sensing channel, the (P−1)-th sensing channel, the (P+2)-th sensing channel and the (P+3)-th sensing channel by turning on all the (P−2)-th shield switch, the (P−1)-th shield switch, the (P+2)-th shield switch and the (P+3)-th shield switch.

11. The sensing circuit of claim 10, wherein:

a P-th sensing control signal among the plurality of sensing control signals is activated to turn on the P-th signal selection switch, a (P+1)-th reference sensing control signal from the plurality of reference sensing control signals is activated to turn on the (P+1)-th reference selection switch, and while both the P-th sensing control signal and the (P+1)-th reference sensing control signal are activated, all a (P−2)-th shield control signal, a (P−1)-th shield control signal, a (P+2)-th shield control signal and a (P+3)-th shield control signal from the plurality of shield control signals are activated to turn on all the (P−2)-th shield switch, the (P−1)-th shield switch, the (P+2)-th shield switch and the (P+3)-th shield switch.

12. The sensing circuit of claim 9, wherein:

after a P-th sensing operation is performed by selecting the P-th sensing channel as the target sensing channel and by selecting the (P+1)-th sensing channel as the reference sensing channel, a (P+1)-th sensing operation is performed by selecting the (P+1)-th sensing channel as the target sensing channel and by selecting the P-th sensing channel as the reference sensing channel, and while the (P+1)-th sensing operation is performed, the (P−2)-th sensing channel, the (P−1)-th sensing channel, the (P+2)-th sensing channel and the (P+3)-th sensing channel are maintained as the at least one adjacent shield sensing channel.

13. The sensing circuit of claim 8, further comprising: a control signal generator configured to generate the initialization control signal, the plurality of shield control signals, the plurality of sensing control signals and the plurality of reference sensing control signals.

14. The sensing circuit of claim 13, wherein the control signal generator includes:

a plurality of shift registers connected in series, and configured to operate based on a sensing reset signal, a sensing enable signal and a sensing clock signal;

a plurality of level shifters configured to perform a level change on outputs of the plurality of shift registers; and a plurality of high voltage logics configured to generate the plurality of sensing control signals, the plurality of reference sensing control signals and the plurality of shield control signals based on outputs of the plurality of level shifters.

15. The sensing circuit of claim 8, wherein:

the plurality of sensing channels include a first sensing channel to a Z-th sensing channel, where Z is a natural number that is an even number greater than or equal to six, and when a P-th sensing channel is selected as the target sensing channel from among the first to Z-th sensing channels, where P is a natural number that is an odd number greater than or equal to three and less than or equal to (Z−3), a (P+1)-th sensing channel is selected as a reference sensing channel corresponding to the target sensing channel from the first to Z-th sensing channels, and at least one of the first sensing channel to a (P−1)-th sensing channel included in the first to Z-th sensing channels and at least one of a (P+2)-th sensing channel to the Z-th sensing channel included in the first to Z-th sensing channels are selected as the at least one adjacent shield sensing channel.

16. The sensing circuit of claim 1, wherein the signal current integrator includes:

an operational amplifier including a first input terminal sequentially receiving the plurality of sensing currents, a second input terminal receiving the initialization voltage, and an output terminal sequentially outputting the plurality of sensing voltages;

a reset switch connected between the first input terminal and the output terminal of the operational amplifier; and a feedback capacitor connected in parallel with the reset switch between the first input terminal and the output terminal of the operational amplifier.

17. The sensing circuit of claim 1, further comprising an analog-to-digital converter configured to convert the plurality of sensing voltages into a plurality of digital codes.

18. A display driver integrated circuit configured to drive a display panel including a plurality of pixels, the display driver integrated circuit comprising:

a data driver configured to generate a plurality of data voltages applied to the plurality of pixels, and including a sensing circuit configured to detect characteristics of the plurality of pixels through a plurality of sensing channels, wherein:

the sensing circuit includes:

a plurality of initialization switches configured to apply an initialization voltage to the plurality of sensing channels based on an initialization control signal;

a plurality of shield switches configured to apply a fixed-value shield voltage different from the initialization voltage to the plurality of sensing channels based on a plurality of shield control signals;

a plurality of signal selection switches configured to sequentially output a plurality of sensing currents received from the plurality of sensing channels based on a plurality of sensing control signals; and a signal current integrator configured to sequentially convert the plurality of sensing currents into a plurality of sensing voltages, and concurrent with the signal current integrator converting a target sensing current, among the plurality of sensing currents, received from a target sensing channel, among the plurality of sensing channels, into a target sensing voltage among the plurality of sensing voltages, the fixed-value shield voltage is applied to at least one adjacent shield sensing channel that is adjacent to the target sensing channel.

19. The display driver integrated circuit of claim 18, further comprising:

a timing controller configured to generate output image data based on input image data, and to generate compensation data used to compensate deterioration associated with the characteristics of the plurality of pixels based on the plurality of sensing voltages, wherein the data driver is configured to generate the plurality of data voltages based on the output image data and the compensation data.

20. A sensing circuit connected to a plurality of pixels in a display panel through a first sensing channel to an X-th sensing channel, where X is a natural number greater than or equal to three, the sensing circuit comprising:

a first initialization switch to an X-th initialization switch connected to the first to X-th sensing channels, and configured to simultaneously apply an initialization voltage to the first to X-th sensing channels based on an initialization control signal;

a first shield switch to an X-th shield switch connected to the first to X-th sensing channels, and configured to apply a fixed-value shield voltage different from the initialization voltage to the first to X-th sensing channels based on a first shield control signal to an X-th shield control signal;

a first signal selection switch to an X-th signal selection switch connected to the first to X-th sensing channels, and configured to sequentially output a first sensing current to an X-th sensing current received from the first to X-th sensing channels based on a first sensing control signal to an X-th sensing control signal;

an operational amplifier including a first input terminal sequentially receiving the first to X-th sensing currents, a second input terminal receiving the initialization voltage, and an output terminal sequentially outputting a first sensing voltage to an X-th sensing voltage;

a reset switch connected between the first input terminal and the output terminal of the operational amplifier; and a feedback capacitor connected in parallel with the reset switch between the first input terminal and the output terminal of the operational amplifier, wherein:

concurrent with the operational amplifier outputting the first sensing voltage in response to receiving the first sensing current, the fixed-value shield voltage is applied to a second sensing channel, concurrent with the operational amplifier outputting a K-th sensing voltage in response to receiving a K-th sensing current, where K is a natural number greater than or equal to two and less than or equal to (X−1), the fixed-value shield voltage is applied to a (K−1)-th sensing channel and a (K+1)-th sensing channel, and concurrent with the operational amplifier outputting the X-th sensing voltage in response to receiving the X-th sensing current, the fixed-value shield voltage is applied to an (X−1)-th sensing channel.

* * * * *